US007522117B2

(12) United States Patent
Takahashi

(10) Patent No.: US 7,522,117 B2
(45) Date of Patent: Apr. 21, 2009

(54) ANTENNA STRUCTURE AND RADIO-CONTROLLED TIMEPIECE

(75) Inventor: Shigeyuki Takahashi, Tokyo (JP)

(73) Assignee: Citizen Holdings Co., Ltd., Tokyo (JP)

( * ) Notice: Subject to any disclaimer, the term of this patent is extended or adjusted under 35 U.S.C. 154(b) by 284 days.

(21) Appl. No.: 10/582,144

(22) PCT Filed: Dec. 9, 2004

(86) PCT No.: PCT/JP2004/018775

§ 371 (c)(1),
(2), (4) Date: Jun. 7, 2006

(87) PCT Pub. No.: WO2005/057726

PCT Pub. Date: Jun. 23, 2005

(65) Prior Publication Data

US 2007/0120758 A1 May 31, 2007

(30) Foreign Application Priority Data

Dec. 12, 2003 (JP) ..... 2003-414439

(51) Int. Cl.
*H01Q 1/00* (2006.01)

(52) U.S. Cl. ..... 343/787

(58) Field of Classification Search ..... 343/787, 343/788, 718, 741, 895
See application file for complete search history.

(56) References Cited

U.S. PATENT DOCUMENTS 4,947,179 A * 8/1990 Ganter et al. ..... 343/718
5,625,370 A * 4/1997 D'Hont ..... 343/788
5,796,324 A * 8/1998 Ross et al. ..... 336/192
6,163,305 A * 12/2000 Murakami et al. ..... 343/788
6,400,330 B1 * 6/2002 Maruyama et al. ..... 343/788
2004/0266486 A1 * 12/2004 Deguchi et al. ..... 455/562.1
2005/0146472 A1 * 7/2005 Ihara et al. ..... 343/718
2006/0214866 A1 * 9/2006 Araki et al. ..... 343/788
2007/0024516 A1 * 2/2007 Araki et al. ..... 343/788

FOREIGN PATENT DOCUMENTS

EP 0 549 832 7/1993
EP 0 677 887 10/1995
EP 1 689 029 8/2006
JP 40-30256 10/1940

(Continued)

*Primary Examiner*—Huedung Mancuso
(74) *Attorney, Agent, or Firm*—Greer, Burns & Crain, Ltd.

(57) ABSTRACT

An antenna structure capable of receiving an external radio signal has a structure that enables reception of magnetic flux caused by an external radio signal, but has a magnetic path that makes it difficult for magnetic flux generated by resonance to leak to said outside of said antenna structure, said magnetic path being formed minimally by an antenna part, which is formed by at least one antenna core part and a coil part formed by winding of a conductive wire around said antenna core part, and a cover part disposed in a vicinity of said antenna part and covering at least a part of said antenna part, said antenna core part and cover part being made of a soft magnetic material, and also said cover part being joined to said antenna part at both ends of said antenna core part of said antenna part.

23 Claims, 13 Drawing Sheets

FOREIGN PATENT DOCUMENTS

| | | |
|---|---|---|
| JP | 35-23850 | 9/1960 |
| JP | 08-307141 | 11/1996 |
| JP | 11-353561 | 12/1999 |
| JP | 2000-114854 | 4/2000 |
| JP | 2004-104551 | 4/2004 |
| JP | 2004-144481 | 5/2004 |
| WO | WO 2004/025782 | 3/2004 |

* cited by examiner

ANTENNA STRUCTURE AND RADIO-CONTROLLED TIMEPIECE

BACKGROUND OF THE INVENTION

1. Field of the Invention

The present invention relates to an antenna structure and to a radio-controlled timepiece that uses the antenna structure, and more particularly it relates to an antenna structure especially for a resonance antenna, which is configured so that even in the case in which the antenna structure is disposed in the vicinity of a metal object, the receiving performance of the antenna structure does not decrease, and to a radio-controlled timepiece that uses the antenna structure as mentioned above.

2. Related Art

In recent years many wristwatch products using radio signals have appeared.

Specifically, known products include a wristwatch with a radio in which a radio function is added within the wristwatch so as to obtain prescribed information by receiving a broadcasted radio signal, a radio-controlled timepiece that receives a standard radio signal onto which is superimposed a time code so as to automatically adjust the time of the wristwatch to the standard time during use, and a remotely controlled wristwatch.

In a wristwatch, however, in order to use a radio signal an antenna and receiving circuit are necessary, and it is not only necessary to use components and a design that are completely different from watches in the past, but also to consider the issue of not hindering receiving performance.

Specifically, there is the problem of how to improve the antenna receiving performance and also the restriction in designing with regard to size and design because of the placement of the antenna inside or on part of the outer case of the wristwatch.

In particular the antenna, which greatly influences the performance of receiving a radio signal, has a size that is considerable larger than the other components of wristwatches of the past and further, since a placement of the antenna is restricted with respect to the receiving performance thereof, various methods were used, such as internal mounting, external mounting, extendable/retractable mounting, or cord-type mounting.

The internal mounting method is generally used with a bar type antenna formed by a magnetic core and a coil, and when mounting within a wristwatch, it is necessary to take care with regard to the case material and structure, and with regard to design, in order that the receiving performance is not decreased.

In the case of external mounting, in a method such as the extendable/retractable method used in radio-cassette recorder combinations or a cord-type method in which a cord is also used for earphones or the like, it is necessary to consider the overall design, storability, and endurance and the like of the watch.

In this situation, in order to achieve not only compactness and thinness, but also fashionable appearance in a wristwatch, it is of course necessary to give sufficient consideration not only to not causing a drop in receiving performance of the antenna, but also to ease of portability and designability, thereby leading to a demand to make the antenna smaller.

In a radio-controlled timepiece it is the antenna characteristics and the receiving circuit characteristics that determine the receiving performance, the lower limit of the signal input to a receiving circuit or a receiving IC being a signal amplitude of approximately 1 μV at present, so that in order to achieve practically useful receiving performance, it was necessary to obtain an output having a signal amplitude of approximately 1 μV with an antenna in an electrical field strength (strength of the radio waves) of 40 to 50 dBμV/m.

For this reason, in the case of a size restriction, a resonant-type receiving antenna, which enables the achievement of a large signal output, is generally used, and further, regarding the type of the receiving antenna, since the wave length of the radio wave is long, a bar antenna in which conductive wire is wound on a magnetic core is typically used.

With this type of receiving antenna, because the output of the receiving antenna is approximately proportional to the size of the receiving antenna, it is not possible to make a size of the antenna too small in order to obtain practically usable receiving performance.

Accordingly, there are problems in selecting a material or in positioning of a member used in a place or in the vicinity of the antenna so that the receiving characteristic should not be reduced in the case of a compact wristwatch.

In particular, because there is an extreme decrease in the output of the antenna when it is housed in a metal outer case, consideration is necessary so that receiving performance is not hindered.

For this reason, in order to use a radio signal in a wristwatch, it is necessary not only to use the component structures and a design that are completely different from those of watches in the past, but also to consider the issue of not hindering receiving performance.

In the case of a radio-controlled timepiece of the past, the mounting of the antenna was generally made by external mounting method and by internal mounting method, and in the case in which the outer case comprising a bottom cover part and a side part was made of metal, mounting of the receiving antenna was generally made outside.

Because a non-metal such as plastic or the like was used in order that the antenna case does not cause a decrease in receiving performance, there was a large protrusion, so that not only were compactness, thinness, and portability lost, but also there was a prominent loss in the degree of freedom of design.

Also, in the case of an internal receiving antenna, although ceramic or plastic is used as a material for the outer case (bottom cover part and side parts) of the wrist watch in order not to reduce the receiving performance, because these materials have little strength, the thickness thereof increases, thereby causing a loss of housing capacity and portability, and also greatly restricting design, resulting in a wrist watch that is lack of high quality feeling with massive feeling in its appearance.

For this reason, in the past, for example as can be seen in Japanese Unexamined Utility Model Publication No. 2-126408, a metal antenna has been disposed within a leather band of the watch.

Also, as disclosed in Japanese Unexamined Utility Model Publication No. 5-81787 by the applicant of this patent application, there an instance in which an antenna in which a coil is wound around a core is disposed between the dial plate and the windshield, which distances it from the metal outer case itself that would interfere with the radio waves and also provides a unique design, and in international patent disclosure WO95/27928, there is the disclosure of the mounting of an antenna on the side part of a watch case of a wristwatch.

Additionally, in European patent disclosure 0382130, there is also a disclosure of the disposition of an antenna for example on the top surface of a case in a ring shape.

However, in a configuration in which the antenna is disposed in the band, because the antenna exists inside the band, it is necessary to make electrical connection with the electronic apparatus, and it is not possible to impart sufficient flexibility to the connection part between the two.

Additionally, it is not possible to use a band of metal, which would interfere with radio waves, and it is necessary to use a band of rubber or the like, this presenting a restriction in terms of materials and design.

In a configuration in which the antenna is mounted on the upper surface or side surface of a wrist watch because the antenna is at a distance from the metal part of the wrist watch itself, there is an increase in the thickness or size of the overall watch, thereby causing a problem of a design restriction.

Additionally, in the instance in European patent 0382130, in which the antenna is disposed in a ring shape on the upper surface of the case, because reception is not possible if metal exists within the ring, there is the problem of the practical necessity to provide antenna that is separate from the watch.

Additionally, although in Japanese Unexamined Patent Publication No. 11-64547 there is a disclosure of a wristwatch in which a coil is disposed in a channel-shaped depression provided around the periphery of a circuit board and in which a core is disposed in a curve along the circumferential direction of the circuit board, in addition thereto the manufacturing process thereof is made complex, and further the assembly process in the manufacturing process also becomes complicated leading it troublesome.

In the Japanese Unexamined Patent Publication No. 2001-33571 or Japanese Unexamined Patent Publication No. 2001-305244 and the like, there is disclosure of a wristwatch in which the windshield and bottom cover part are made of a non-metallic material such as glass or ceramic or the like, and a metal material as in the past is used therebetween so that sufficient radio waves reach the antenna.

Specifically, in the above-noted examples of the past, the output of the receiving antenna was based on a fact that it is extremely reduced when the antenna is externally mounted on a metal outer case, and the object is to make the material of the bottom cover with non-metallic so as to reduce the drop in output and use sides of a metal that has a high massive feeling in its appearance.

In the above-noted prior example, however, because glass or ceramic is used, there is the problem that the thickness of the watch increases. Also, because either a large sized high-sensitivity antenna structure was used or usage thereof was limited to an area in which the radio signal field strength was high, the convenience of the radio-controlled timepiece is suffered.

Furthermore, in a wristwatch having this configuration, although it was possible to achieve a radio signal that reached the antenna, and the bottom cover part was thinly plated with a metallic plating so as to give the user the impression that metal was actually being used, in terms of outer appearance, there was no feeling of weightiness or textural quality, so that the high-quality image was lost.

For this reason, compactness, thinness, portability, freedom of design, massive feeling in appearance (feeling of high quality) are important factors and, in spite of a demand for a type with a metal outer case and a built-in antenna, in the past there were no radio-controlled timepiece with a fully metal outer case and a feeling of high quality.

Also, in the past, as shown in FIG. 3, in the case in which an antenna structure 102 for the purpose of receiving an external radio signal is disposed on the inside of a metal outer case 103 having electrical conductivity, for example, inside the side or bottom cover (hereinafter collectively referred to as the metal outer case in the present invention) used as the outer case of the watch made, for example, of stainless steel, titanium, or a titanium alloy or the like, considering that the magnetic flux 104 of the external radio signal are absorbed by the metal outer case 103 so that the external radio signal does not reach the antenna structure 102 and the output of the antenna drops, in order to improve the sensitivity of the antenna structure 102, the antenna structure 102 was made large and, the antenna structure 102 was provided outside the metal outer case 103 or a plastic or ceramic outer case was used instead of the metal outer case 103, and in order to achieve an accompanying improvement in the quality of the outer appearance, a thin metal plating or metallic paint was applied to a non-metallic surface.

The inventors of the subjection invention, however, as a result of further study, discovered that the above-noted understanding of the problem in the past was in error, and that even if the antenna structure 102 is disposed within a metal outer case 103 of metal that has electrical conductivity, the external radio signal substantially reaches the antenna structure 102, the problem being, as shown in FIG. 3, that the magnetic flux 105 generated from the antenna core part 106 of the antenna structure 102 at the time of resonance interacts with the metal outer case 103 (as eddy current loss), so that there is a resulting loss of magnetic energy, causing the Q value of the resonant antenna to decrease, so that there is a decrease in the voltage output of the antenna structure 102, thereby greatly reducing the receiving performance.

DISCLOSURE OF THE INVENTION

Accordingly, an object of the present invention is to solve the above-noted problems of the past, by providing an antenna structure usable in a metal outer case, which provides good radio signal receiving performance without the imposition of restrictions with regard to materials and design, and a radio-controlled timepiece using the antenna structure.

Another object is to provide an antenna apparatus of a wristwatch, which, when the present invention is applied to a wristwatch, in addition to achieving the above-noted object, prevents an increase in the thickness of the wristwatch and provides an attractive appearance when worn on the wrist.

In order to achieve the above-noted objects, the present invention adopts the following basic technical constitution. Specifically, a first aspect of the present invention is an antenna structure capable of receiving an external radio signal, the antenna structure comprising a magnetic path that enables reception of magnetic flux caused by an external radio signal, but makes it difficult for magnetic flux generated by resonance to leak to the outside of the antenna structure, the magnetic path being formed minimally by an antenna part, which is formed by at least one antenna core part and a coil part formed by winding of a conductive wire around the antenna core part, and a cover part disposed in a vicinity of the antenna part and covering at least a part of the antenna part, the antenna core part and cover part being made of a soft magnetic material, and also the cover part being joined to the antenna part at both ends of the antenna core part of the antenna part.

Additionally, a second aspect of the present invention is a radio-controlled timepiece comprising means for generating a reference signal that outputs a reference signal, timekeeping means for outputting timekeeping information based on the reference signal, display means for displaying a time based on the timekeeping information, receiving means for receiving a standard radio signal having standard time information, and a means for correcting the output time information of the timekeeping means based on the received signal from the receiving means, wherein the receiving means includes an antenna structure having a structure as mentioned above.

BEST MODE FOR PRACTICING THE PRESENT INVENTION

Embodiments of the antenna structure according to the present invention and a radio-controlled timepiece using the above-mentioned antenna are described in detail below, with references made to the drawings.

EMBODIMENTS

Figure 1:
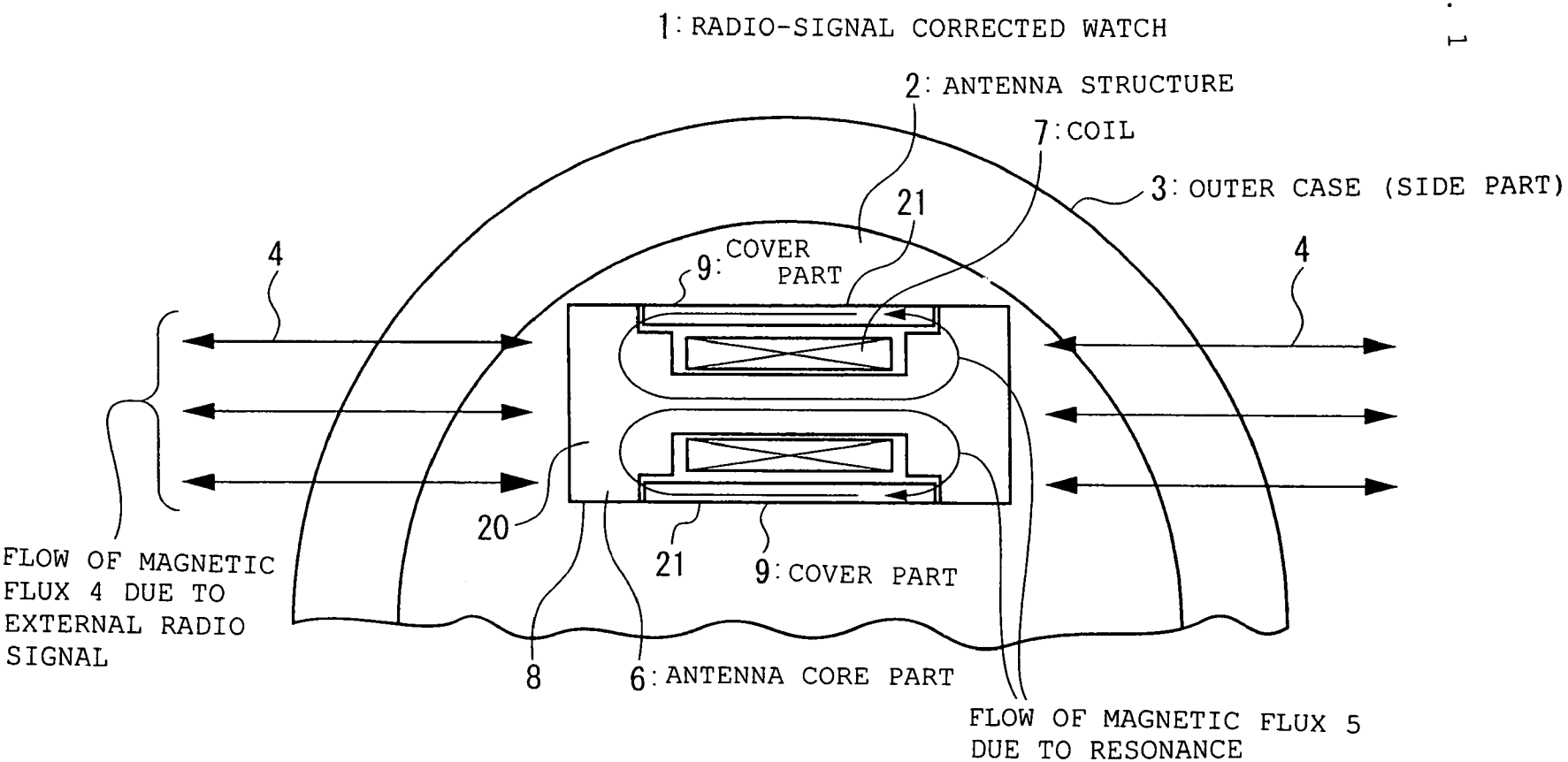
FIG. 1 is a drawing showing the configuration of a specific example of an antenna structure according to the present invention disposed in a wristwatch.

Specifically, FIG. 1 is a drawing showing the configuration of a specific example of an antenna structure according to the present invention, this being the antenna structure 2, which can receive an external radio signal, the antenna structure 2 having a magnetic path of a construction that enables it to receive magnetic flux 4 by an external radio signal, but which makes it difficult for magnetic flux 5 caused by resonance to leak to the outside, the magnetic path having antenna part 8 having at least one antenna core part 6 and a coil part 7 formed by the winding of a conductive wire around the antenna core part 6, and a cover part 9 covering at least a part of the antenna part 8 disposed in the vicinity of the antenna part 8, wherein the antenna core part 6 and cover part 9 are made of a soft magnetic material, and also the cover part 9 being joined to the antenna part 8 at both ends of the antenna core part 6 of the antenna part 8.

A first embodiment having a more specific configuration of the antenna structure 2 of the present invention is described in detail below.

Embodiment 1

Specifically, as shown in FIG. 1, the antenna structure 2 according to the first embodiment of the present invention is the antenna structure 2 that, as noted above, is used inside a metal outer case 3 and that receives a radio signal, the antenna structure 2 being formed by an antenna part 8 having an antenna core part 6 made of a soft magnetic material, and a coil part 7 formed by the winding of a conductive wire around the antenna core part 6, and a cover part 9 made of a soft magnetic material covering at least a part of the antenna part 8, the construction being such that, for example, the cover part 9 is joined to the antenna core part 6 via a joining part 10 and the antenna core part 6 and cover part 9 forming a substantially closed magnetic path, so that because the magnetic flux 7 generated at the time of resonance flows through this substantially close magnetic path, it is difficult for the magnetic flux 7 generated by resonance to leak to the outside of the antenna structure 2.

Essentially, in the present invention the cover part 9 has the function of passing the magnetic flux generated by resonance, so that it is together with the antenna core part 6, thereby forming a closed magnetic path for the magnetic flux 7 generated at the time of resonance.

The cover part 9 must cover at least a part of the overall periphery of the antenna core part 6 and, while the degree thereof is not particularly restricted, at maximum the cover part 9 covers the entire periphery of the antenna core part 6, and it is possible to adopt an arbitrary covering condition for the cover part 9, including this maximum covering condition.

It is preferable that the cover part 9 be mutually connected to each other via an appropriate joining part 10 formed in the antenna core part 6.

The more detailed structure of an example of the above-noted antenna structure 2 according to the present invention is described below, using FIG. 2A and FIG. 2B.

Specifically, the antenna structure 2 shown in FIG. 2A and FIG. 2B is an example in which the cover part 9 is a channel-shaped body (U-shaped body), FIG. 2A being a cross-sectional view of the antenna structure 2 and FIG. 2B being an assembly drawing of the antenna core part 6 and the cover part 9, wherein the two ends R1 and R2 that form the channel shape of the cover part 9 fit onto the step parts 67 and 68 of the joining part 10 formed on the two end parts 61 and 62 of the antenna core part 6.

In this specific example, the cover part 9 covers ¾ of the total periphery of the antenna core part 6.

Figure 19:
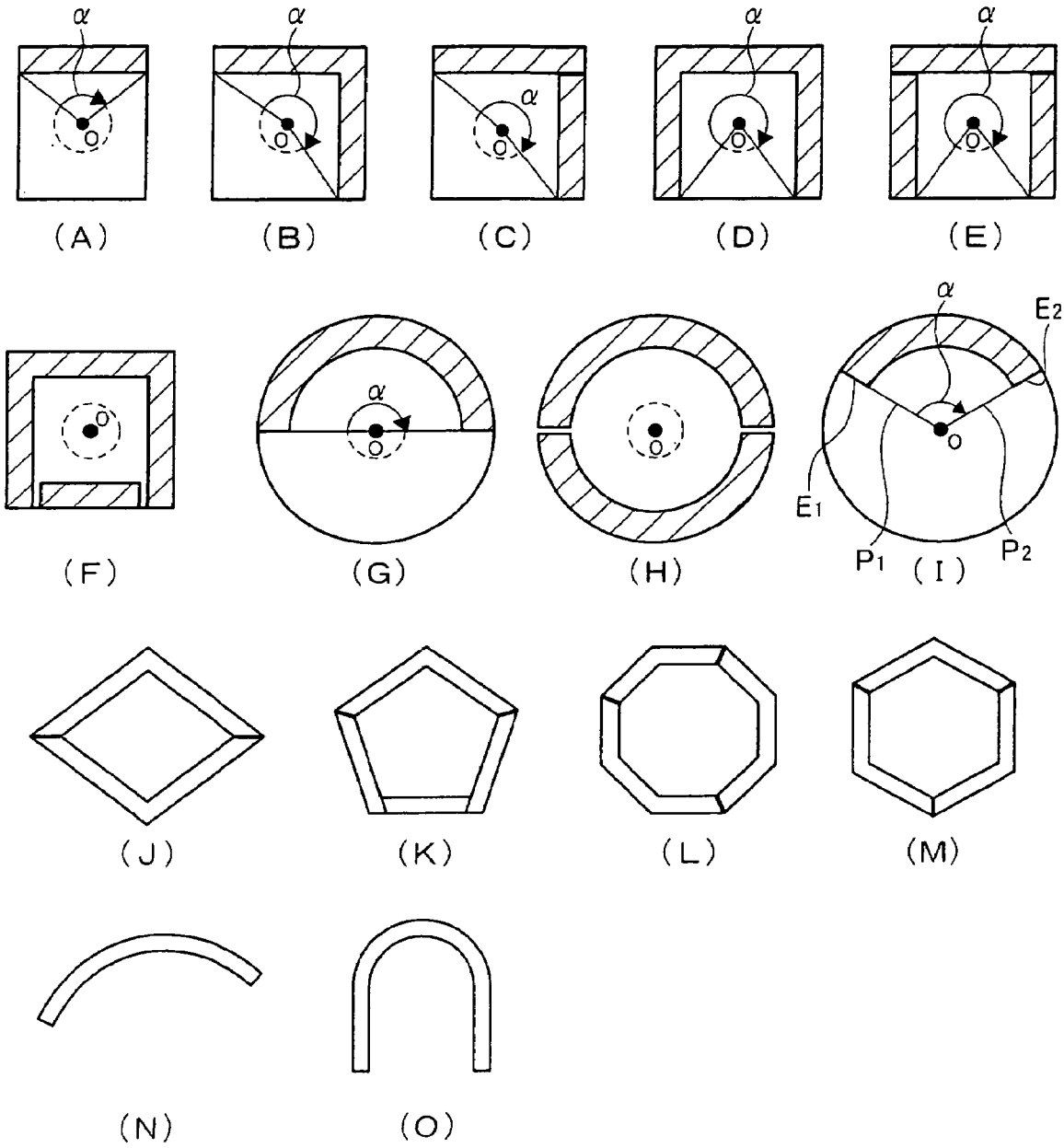
FIG. 19 is an oblique view showing the configuration of another specific example of an antenna structure according to the present invention.

Although the shape of the cover part 9 used in the present invention is not restricted to the shape shown in FIG. 2A and FIG. 2B, and is not also restricted to any particular shape, it is desirable, for example, that the cross-sectional shape as seen in a plane that perpendicularly intersects the longitudinal axis of the cover part 9 be, as shown in FIG. 19, a flat plate like member, L-shaped member, channel-shaped member (U-shaped member), curved member, rounded member, a closed polygonal member or a combination thereof, formed by a plate like member 21 or the combination of a plurality of plate like members 21.

Figure 2:
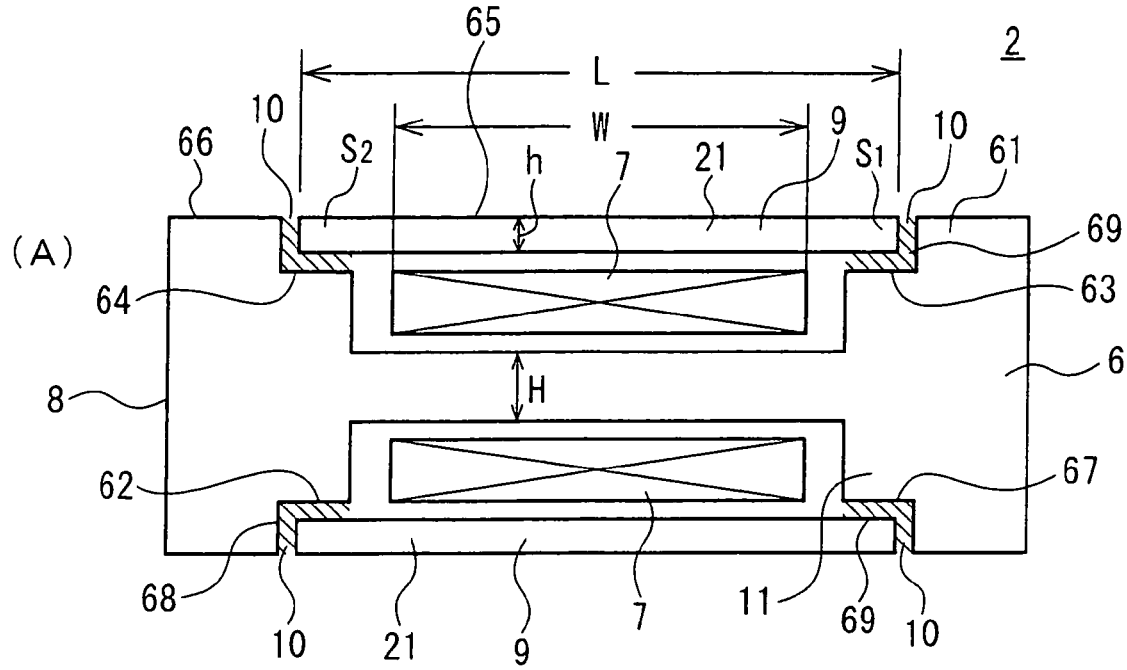
FIG. 2A is a cross-sectional view showing the configuration of a specific example of an antenna structure according to the present invention.
FIG. 2B is an assembly drawing showing the configuration of a specific example of an antenna structure according to the present invention.
Figure 2:
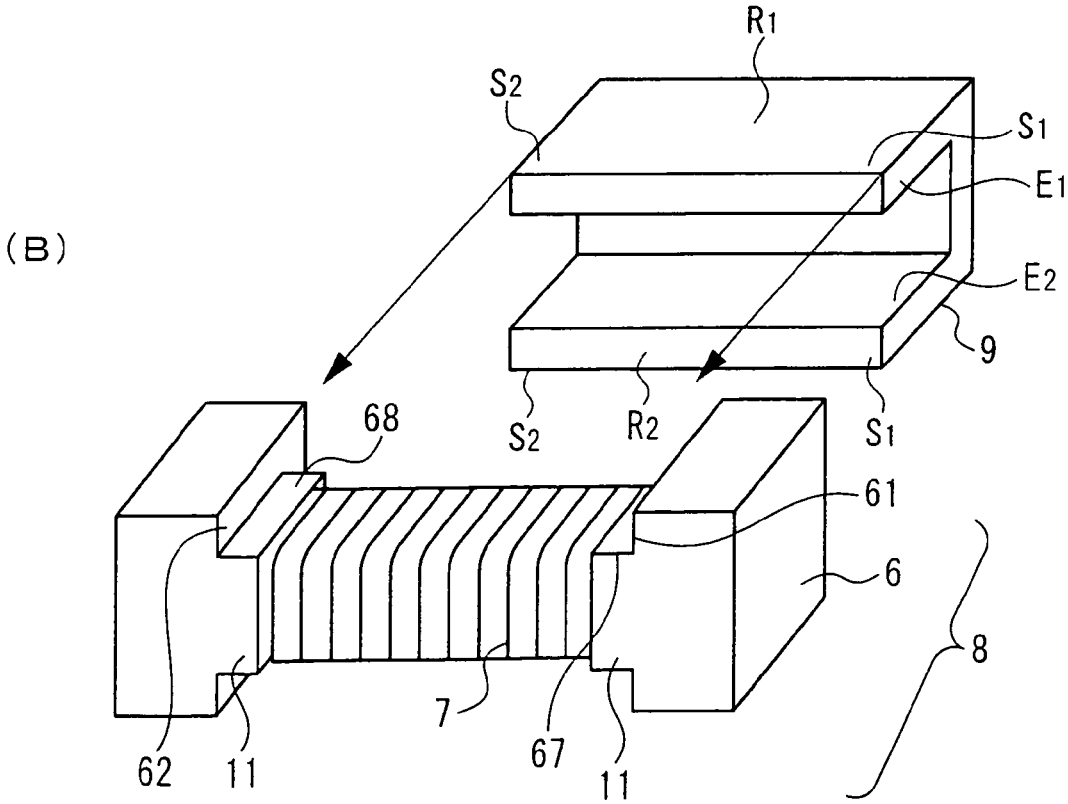
Figure 20:
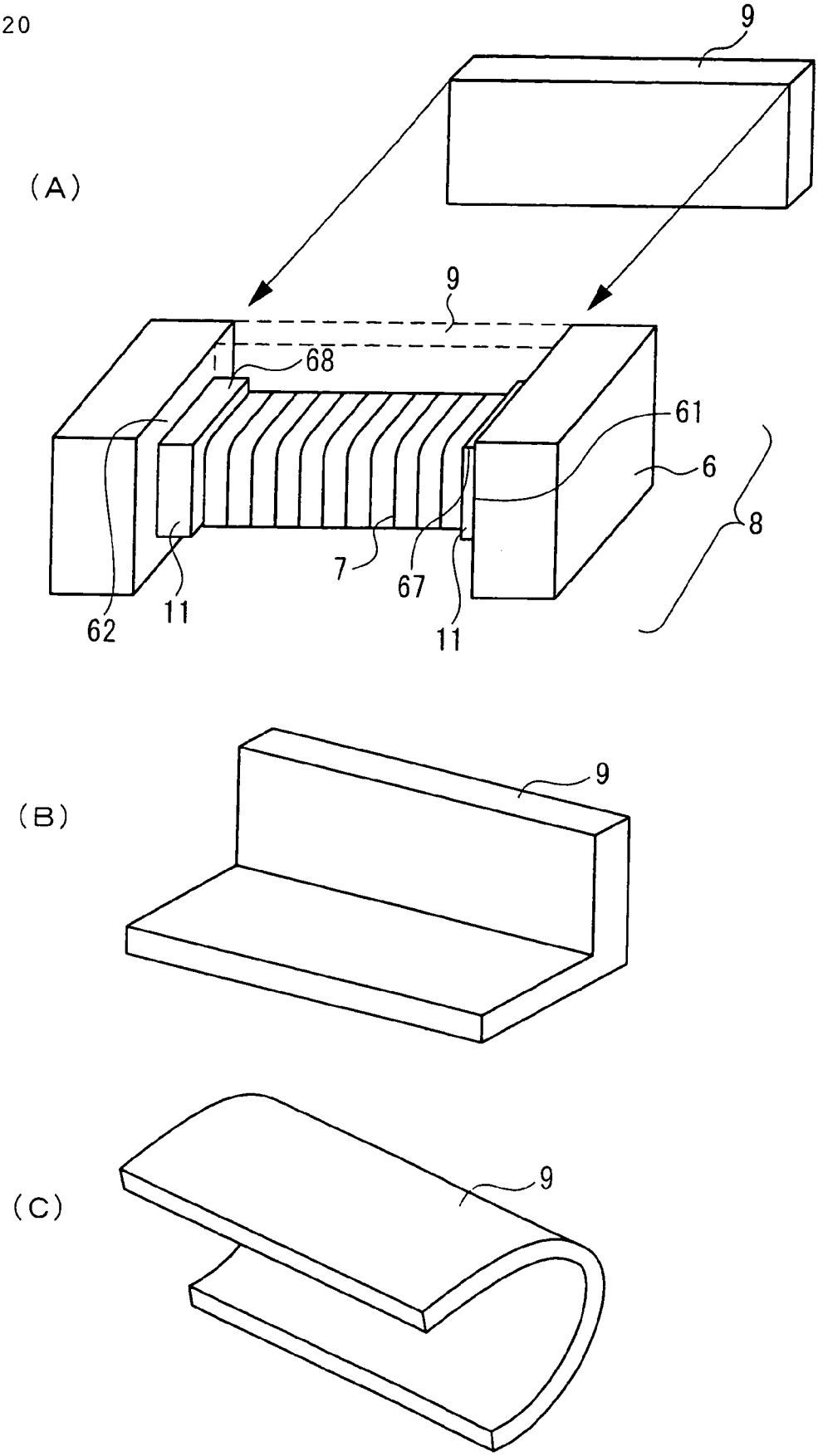
FIG. 20 is a drawing describing a specific example of a cover part used in an antenna structure according to the present invention.

Essentially, as shown in FIG. 20(A), the cover part 9 having a plate like configuration is formed so as to fit onto the step parts 67 and 68 on both ends of the antenna core part 6 in the same manner as in FIG. 2.

In this specific example, the cover part 9 covers ¼ of the overall periphery of the antenna core part 6.

In the same manner, as shown in FIG. 20(B), it is possible to use a cover part 9 that is formed as a single piece having an L-shaped cross-section or a cover part 9 having an L-shaped cross-section formed by connecting two flat plate like members, or it is possible to use a cover part 9 having a cross-section with a circular or curved configuration as shown in FIG. 20(B).

Additionally, in the present invention it is preferable that at least a part of the cover part 9 be configured to enable free attachment and removal with respect to the antenna core part 6, for example in the case in which the cover part 9 covers the entire periphery of the antenna core part 6, at least one part thereof is divided beforehand so that that part can be freely attached and removed.

In the present invention it is preferable that the joining part 10 join the antenna core part 6 and the cover part 9 via a spacer, an adhesive, an adhesive including a spacer, or further via a magnetically modified layer or via an air gap.

Although not shown in FIG. 1, it is also possible for the antenna structure 2 to have lead wires from a coil part 7, connection to a receiving circuit being made via the lead wires, and a capacitor for the purpose of resonating being connected between the lead wires.

In the present invention, it is desirable that the configuration be such that part of the substantially closed magnetic path 20 formed by the antenna core part 6 and the cover part 9 of the antenna structure 2 includes a part having a permeability that is different from the permeability of other parts.

It is preferable that the part having a permeability that differs from other parts be the joining part 10.

Also, the thickness h of the cover part 9 used in the present invention can be formed by a member having a thickness that is thinner than the maximum length H of the cross-section at the center part of the antenna core part 6 of the antenna part 8.

It is preferable that the length L in the longitudinal direction of the cover part 9 used in the present invention be designed so as to be longer than the length W of the coil part 7 in the antenna part 8.

Additionally, as shown in FIG. 19(I), it is preferable that the angle of intersection $\alpha$ formed by the straight lines P1 and P2 joining the center O of the antenna core part 6 of the antenna part 8 and the two ends El and E2 of the cover part 9 in the cross-section intersecting with the longitudinal direction of the cover part 9 be at least 90°.

Specifically, in the present invention although there is the problem of to what degree the cover part 9 should cover the antenna core part 6, as will basically be described later, it is not absolutely necessary for the cover part 9 to cover the overall periphery of the antenna core part 6, and it is clear that there is to some degree of tolerance in the degree of covering, one guide being that it is desirable that the above-noted intersection angle $\alpha$ be at least 90°.

In the antenna structure 2 of the present invention, in a desirable specific example, the cover part 9 is made of either one of a ferrite soft magnetic material, a soft magnetic material in which a fine soft magnetic powder of cobalt or a cobalt alloy is blended into a resin or a compound soft magnetic material made of a laminate of cobalt or cobalt alloy thin films.

In the antenna structure 2 according to the present invention, it is a preferable specific example, in that the antenna core part 6 is made of either one of a ferrite-based soft magnetic material and a soft magnetic material in which a fine soft magnetic power of cobalt or a cobalt alloy is blended into a resin.

In the antenna structure 2 according to the present invention, it is desirable that the two end parts S1 and S2 in the longitudinal direction of the cover part 9 be connected to at least part of the two ends 61 and 62 of the antenna core part 6 of the antenna part 8.

Additionally, in the antenna structure 2 according to the present invention, in a preferable specific example, the two ends parts 61 and 62 in the longitudinal direction of the antenna core part 6 are provided with a appropriate cover part support members 63 and 64 that hold the cover part 9 in a stable condition.

In the antenna structure 2 according to the present invention, although there is no particular restriction, in a desirable specific example the joining condition between the cover part 9 and the antenna core part 6 is, for example, such that the surface part 65 of the cover part 9 is in one and the same plane as the outermost surface 66 of the antenna core part 6, or formed as to be at a position that is lower than the outermost surface 66 of the antenna core part 6.

Additionally, in the antenna structure 2 according to the present invention, although there is no particular restriction in the structure of the cover support parts 63 and 64, it is possible to make step parts 67 and 68 formed on a pair of mutually opposing planes provided on both ends of the antenna core part 6.

It is also clear that the cover support parts 63 and 64 of the present invention need not have a step shape, and it is possible, for example, to provide appropriate protruding parts or protruding rib parts or the like at both ends of the antenna core part 6 and, at corresponding parts on the cover part 9, to provide depression parts or groove parts or the like, so that the two of them mutually mate and are fixedly connected to each other.

The magnetic gap of the joining part 10 in the antenna structure 2 according to the present invention can be formed via a spacer or an adhesive 69 or the like, or can be an air gap.

In the antenna structure 2 according to the present invention, although there is no particular restriction, it is desirable that the surface area of contact formed between the joining part 10 provided at two end parts of the antenna core part 6 in the antenna part 8 and the cover part 9 be made as large as possible, for example it is preferable that it be larger than the cross-sectional area of the cover part 9.

Figure 3:
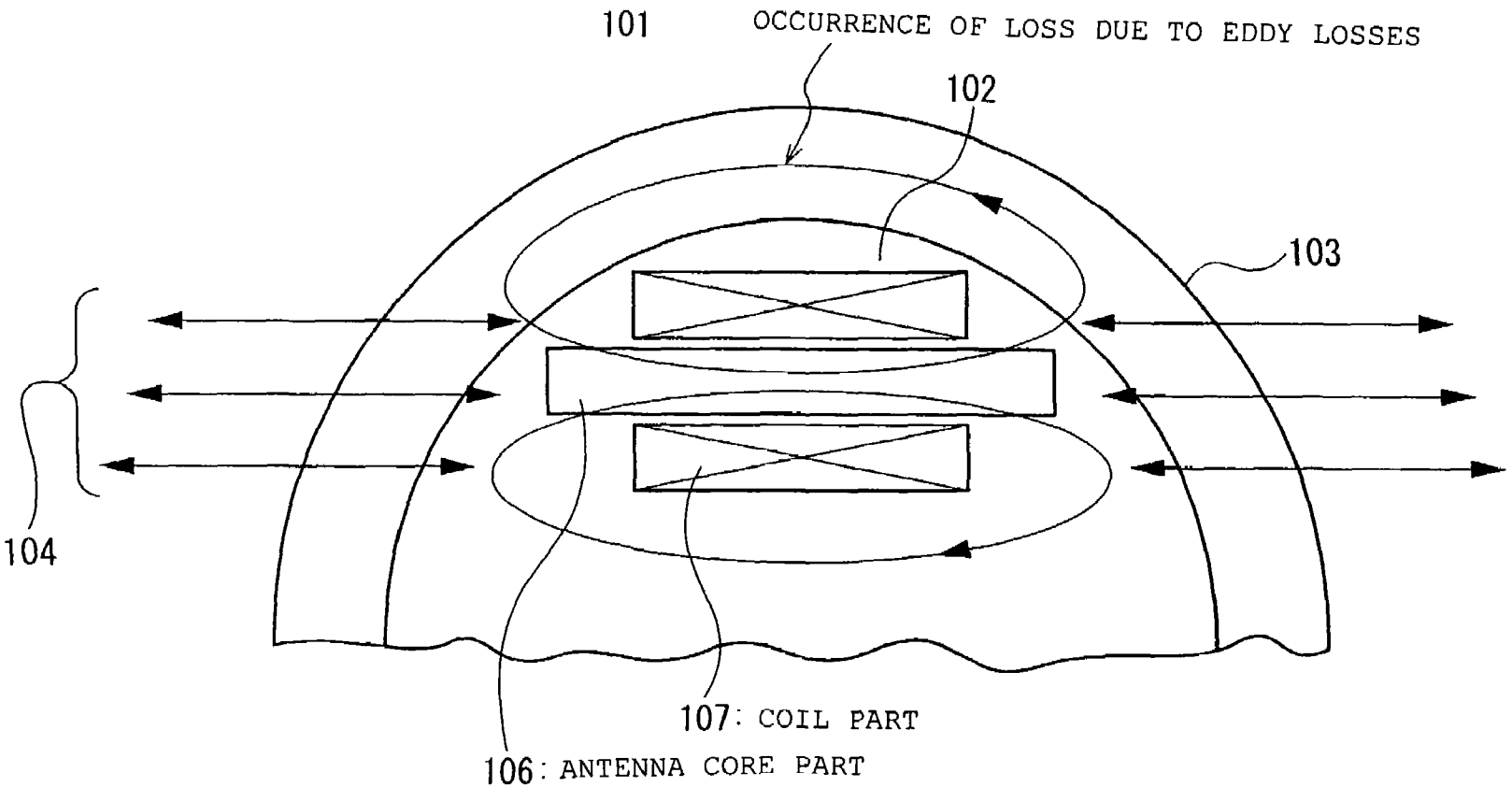
FIG. 3 is a cross-sectional view showing the configuration in a specific example in which an antenna structure of the past is disposed in a wristwatch.

In the past, as shown in FIG. 3, in the case in which, the antenna structure 102 for the purpose of receiving an external radio signal disposed inside a metal outer case 103 having electrical conductivity, for example sides and a bottom cover part forming an outer case of a watch made of stainless steel, titanium, or a titanium alloy or the like (herein collectively referred to as the metal outer case), the magnetic flux 104 caused by the external radio signal is absorbed by the metal outer case 103, and it was thought that the external radio signal does not reach the antenna structure 102, thereby decreasing the output of the antenna. In this case, in order to improve the sensitivity of the antenna structure 102, either the antenna structure 102 itself was made large, or the antenna structure 2 was provided outside the metal outer case 103, or a plastic or ceramic outer case which cannot absorb the external radio signal was used instead of the metal outer case 103, and in order to achieve an accompanying improvement in the quality of the outer appearance, a thin metal plating or metallic paint was applied to a non-metallic surface.

The inventors of the subject invention, however, as a result of further study, discovered that the above-noted understanding of the problem in the past was in error, and that even if the antenna structure 102 is disposed within a metal outer case 103 of metal that has electrical conductivity, the external radio signal substantially reaches the antenna structure 102, the problem being, as shown in FIG. 3, that the magnetic flux 107 generated from the antenna core part 106 of the antenna structure 102 at the time of resonance interacts with the metal outer case 103 (as eddy current loss), so that there is a resulting loss of magnetic energy, causing the Q value of the resonant antenna to decrease, so that there is a decrease in the voltage output of the antenna structure 102, thereby greatly reducing the receiving performance.

With regard to one and the same antenna, in the resonant and non-resonant conditions, with regard to the standalone antenna characteristics and the characteristics in the case in which the antenna is disposed inside a metal outer case, the gain and Q value at resonance of the antenna were measured, the respective results being show in Table 1 and Table 2 below.

In the above-noted experiments, the material used for the metal outer case was a titanium alloy, for which there is a prominent decrease in receiving performance, and the antenna structure was an antenna of the past, in which 400 turns of a conductor were wound around a ferrite core, the resonant and non-resonant operation being adjusted by mounting or removing a capacitance for resonance.

The resonant frequency in this specific example was 40 kHz.

The antenna gain and Q value measurement method in the present invention is described as follows.

Figure 12:
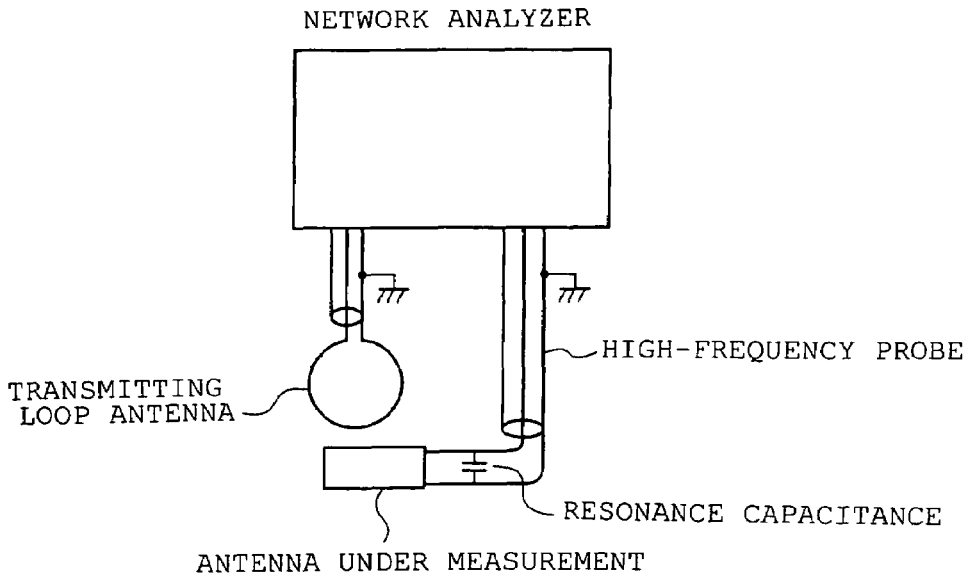
FIG. 12 is a drawing describing a specific example of the method of measuring the antenna gain and Q value in an antenna structure according to the present invention.

Specifically, a network analyzer, a high-frequency probe, and a transmitting loop antenna were connected as shown in FIG. 12 to form an antenna evaluation circuit, the antenna under measurement was placed in the vicinity of the transmitting loop antenna and an antenna evaluation was performed by transmitting a prescribed signal from the transmitting loop antenna and using the network analyzer, via the high-frequency probe, to measure the voltage output of the antenna under measurement.

Figure 13:
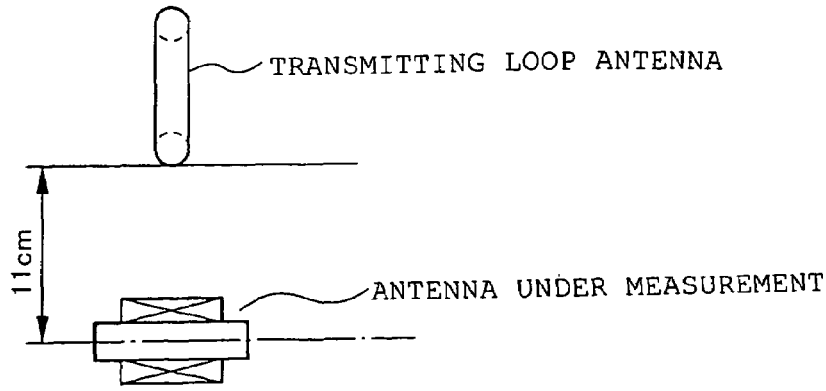
FIG. 13 is a drawing describing a specific example of the method for measuring the antenna gain and Q value in an antenna structure according to the present invention.

In the above-noted evaluation apparatus, the distance between the antenna under measurement and the transmitting loop antenna, as shown in FIG. 13, was set so that the antenna under measurement was 11 cm below the lower edge of the transmitting loop antenna, and in the above-noted example when a resonance antenna for 40 kHz is measured, a measurement was made with the frequency of the radio signal transmitted from the transmitting loop antenna was changed within the range of 20 to 60 kHz, with 40 kHz at the center of the range.

The method of measuring the gain and Q value of the antenna under measurement using the above-noted measurement apparatus is described below, making reference to FIG. 17.

Figure 17:
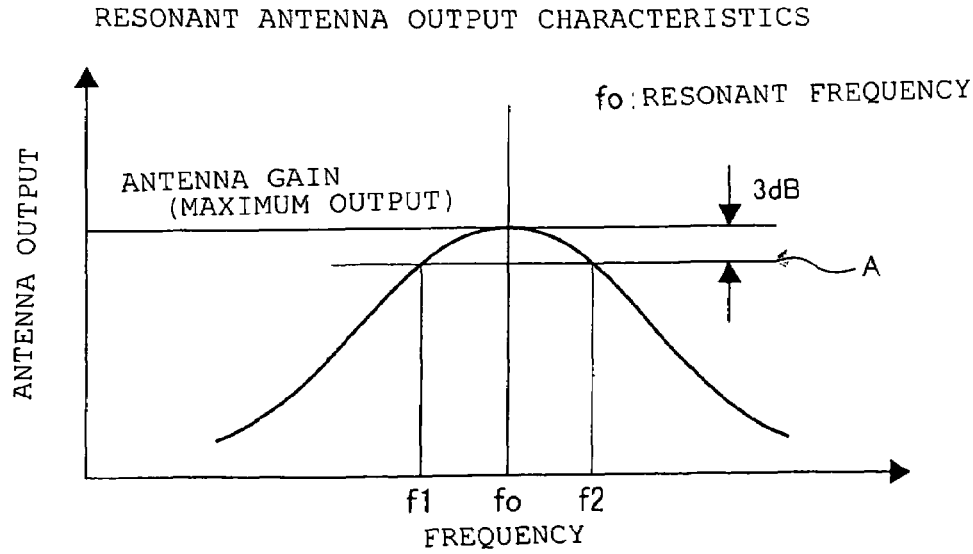
FIG. 17 is a drawing describing a specific example of a measuring the antenna gain and Q value in an antenna structure according to the present invention.

A constant voltage amplitude applied to the transmitting loop antenna from the network analyzer was swept over the range from 20 to 60 kHz, and the output of the antenna under measurement was measured using the network analyzer via the high-frequency probe, thereby producing the output versus frequency results shown in FIG. 17.

The output of the antenna under measurement is expressed as the ratio of the input voltage amplitude to the antenna under measurement and the output voltage amplitude from the antenna under measurement, and in FIG. 17 the value of the above-noted ratio at the point at which the antenna output was maximum was taken as the gain of the antenna, the frequency at the maximum output of the antenna being taken as the resonant frequency (f0). For this reason, the antenna output and gain are not absolute values, but are determined as relative values, which include characteristic values of the measurement apparatus.

The Q value is calculated as follows.

$$Q \text{ value} = \text{resonant frequency } f0 \div (f2 - f1)$$

In the above, in FIG. 17, when the level indicated by "A" is a level lower by about 3 dB ($1/\sqrt{2}$) from the point of the highest antenna output (an output at f0), the frequency imparting the output level are represented by f1 and f2.

TABLE 1

| | Antenna Gain | | |
|---|---|---|---|
| | Antenna Alone | Inside Metal Outer Case | Attenuation (dB) |
| Resonance | −31 dB | −62 dB | −32 dB |
| Non-resonance | −71.5 dB | −74.2 dB | −2.7 dB |

TABLE 2

| | Antenna Q Value | | |
|---|---|---|---|
| | Antenna Alone | Inside Metal Outer Case | Attenuation (dB) |
| Resonance | 114 | 3 | −31 dB |

From the above-noted experimental results, it can be seen that, in the case in which the antenna is in the non-resonant condition, the antenna receives the magnetic flux of the external radio signal and outputs a voltage amplitude in accordance with the number of turns in the coil, and the degree of variation in the magnetic flux, so that in comparing the antenna gain between the antenna alone and the antenna disposed inside a metal outer case, there is reception of at least 70 percent (approximately −3 dB) of the external radio signal even when the antenna is disposed inside the metal outer case.

In the case of the antenna in the resonant condition, however, it was seen that when the antenna is in the metal outer case there is an attenuation of 32 dB in gain compared to the antenna alone, and stated in other terms this is decrease in the voltage output of the antenna to approximately 1/40, and also with regard to the Q value, compared to the Q value of 114 for the antenna alone, the Q value drops to 3 when the antenna is disposed inside the metal outer case, the ratio of decrease being approximately 1/40, this representing a reduction of 31 dB.

From the above-noted results, it can be seen that the reduction in the Q value greatly reduces the antenna output, and that it is not that the external radio signal does not reach to inside the metal outer case.

The Q value, which expresses the characteristics of a resonant antenna, is described further below.

As described using FIG. 17, based upon a relationship between the frequency and the output of the antenna, with frequencies f1 and f2 being the frequencies at which the antenna output is reduced by approximately 3 dB ($1/\sqrt{2}$) from the maximum antenna output, the Q value is calculated as follows.

$$Q \text{ value} \div \text{resonant frequency } f0 \div (f2-f1)$$

Another interpretation of the Q value is that it represents an amount of loss of energy in the antenna in the resonant condition, the reciprocal of the energy loss corresponding to the Q value, so that the Q value is large when the energy loss is small. The antenna output voltage in the resonant condition (because this is an alternating current output, expressed as Vp-p or Vrms) is known to be approximately Q times the antenna output in the non-resonant condition.

If we look at the relationship between the gain and Q value for the antenna alone in the above-noted Table 1 and Table 2, we see that, with respect to the Q value of 114, the gain ratio between resonant and non-resonant conditions is approximately 40 dB, this being convertible to 100 times.

That is, the higher the Q value is, the more improved is the antenna output, and it is judged that the performance is better as an antenna structure, so that this is an important antenna index.

In the present invention the making of the Q value high narrows the frequency passband, and can impart the function of a filter. For this reason, it becomes possible to eliminate unwanted noise from the external radio signal that is input, thereby increasing the sensitivity for the prescribed frequency, thereby making a high Q value desirable from this standpoint as well.

From the above, when an antenna disposed inside a metal outer case receives an external radio signal and is in the resonant condition, there is some prominent loss of energy in comparison with the antenna alone. As a result, the Q value decreases and there is a prominent drop in the antenna output.

Given the above, as a result of detailed investigation of the cause of the energy loss, it can be inferred that magnetic flux generated when the antenna resonates interacts (causes eddy losses) with the surrounding metal outer case, causing a loss of energy of the magnetic flux. Therefore, it can be inferred that reducing this interaction (eddy losses) can suppress the decrease in the Q value and reduction in antenna output.

For this reason, in the present invention, in the case in which the antenna structure 2 is disposed so as to be in contact with or in the vicinity of a metallic material, as a result of an investigation, for the purpose of achieving sufficient antenna output, of how to prevent a decrease in the amount of Q value so that the reduction in antenna output is of a degree that does not present problems in practical use, the present invention was arrived at. Basically, this is the antenna structure 2 that receives a radio signal, the antenna structure 2 having a structure that enables reception of magnetic flux 4 from an external radio signal but which makes it difficult for magnetic flux 7 due to resonance to leak to the outside of the antenna structure. The antenna structure 2 has an antenna part 8 having an antenna core part 6 and a coil part 7 formed by the winding of a conductive wire around the antenna core part 6, and a cover part 9 made of a soft magnetic material covering at least a part of the antenna part 8, wherein the antenna core part 6 and the cover part 9, via a joining part 10, form a substantially close magnetic path, magnetic flux 7 generated at the time of resonance passing through the substantially closed magnetic path formed by the antenna core part 6 and the cover part 9, thereby solving the above-noted problem of the past, and making it easy to manufacture an antenna structure suitable for use in a radio-controlled timepiece having compactness, thinness, and low cost that do not present problems in practical use.

Practical Antenna Characteristics

In the case of placing an antenna outside of a metal outer case, or placing an antenna inside a case made of plastic or ceramic, as done in the past, the antenna gain and Q value are as shown in Table 3 below.

TABLE 3

| | Antenna Alone | Inside Metal Outer Case |
|---|---|---|
| Gain | −31 dB | −40 to −45 dB (approximately ⅓ to ⅕) |
| Q value | 114 | Approximately 30 to 40 |

From the results shown in Table 3, in a radio-controlled timepiece of the past, practical receiving performance of the antenna in the case in which an antenna is mounted in a watch was not, for the antenna alone, a gain of approximately −30 dB, but was approximately −40 to −45 dB when mounted in a watch. In the antenna evaluation system that was used, in the case of an antenna gain of −40 dB, with a field strength (strength of the radio waves) of 40 dBμV/m, the antenna voltage output was a signal amplitude of around 1 μV.

Given the above, an antenna gain of approximately −40 to −45 dB is used as the criterion to judge whether or not the characteristics of the antenna of the present invention are within a practically usable range when the antenna is disposed inside the metal outer case.

From the results in Table 3, it is understood that, in addition to the case in which the antenna structure 102 is disposed either in contact with or in the vicinity of the metal outer case 103, the problem occurs of a decrease in the antenna gain and Q value also in the case in which the antenna structure 102 is disposed in the vicinity of constituent elements of the watch movement, including a battery, for example, a solar battery, a converter, a gear train, and a microcomputer, or a member made of metal, such as a dial plate or the like.

Figure 4:
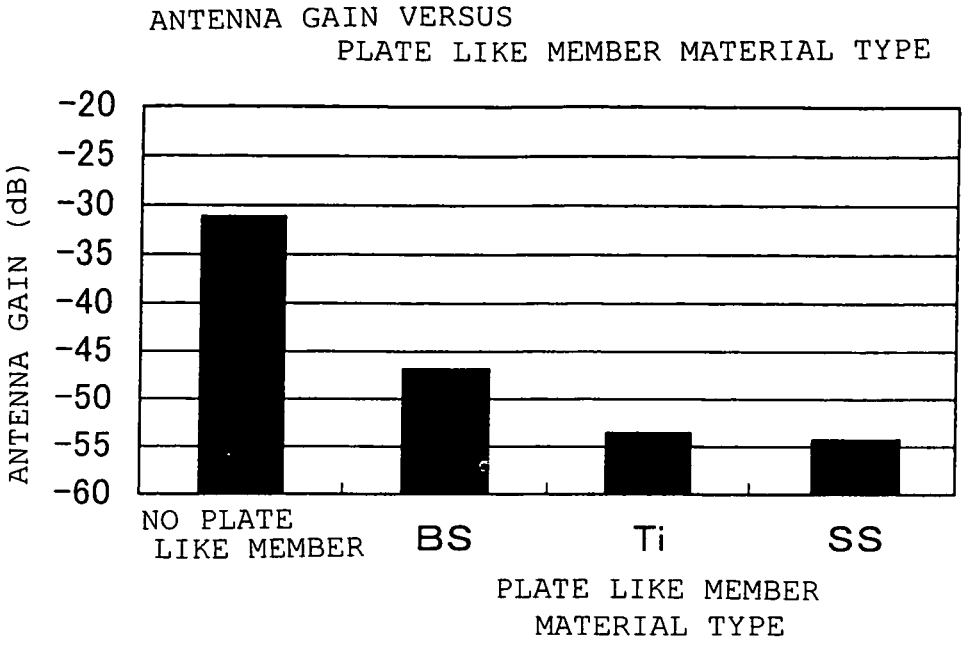
FIG. 4 is a graph showing the relationship between the antenna gain and the plate like member material type.
Figure 5:
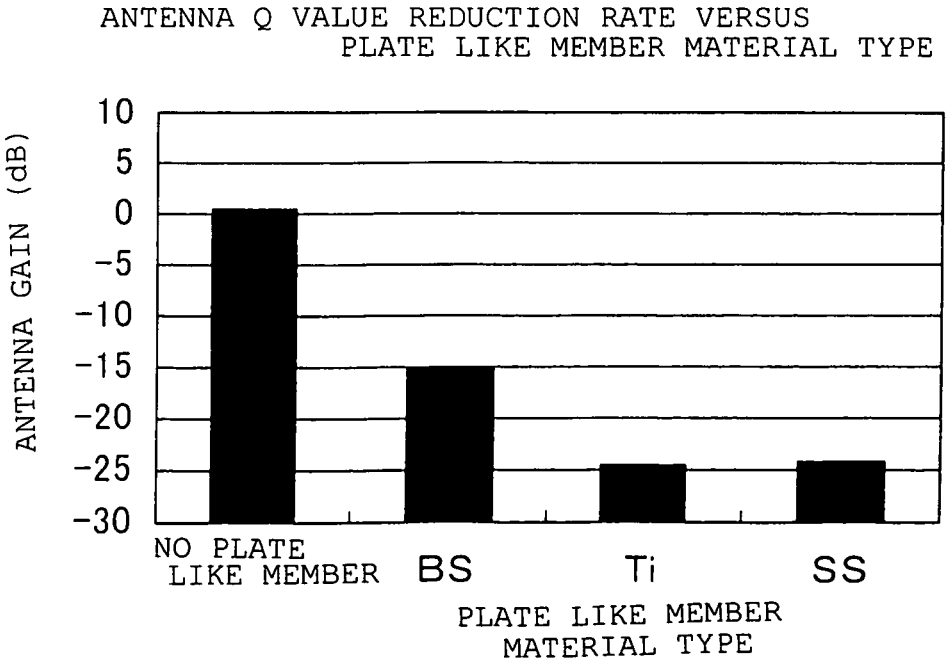
FIG. 5 is a graph showing the relationship between the Q value attenuation rate and the plate like member material type.

FIG. 4 and FIG. 5 shows a comparison of the antenna characteristics for various metal types in an antenna of the past in which 400 turns of a conductor are wound around a ferrite core, FIG. 4 being a comparison of the measured gain as an antenna characteristic, and FIG. 5 showing the attenuation ratio, expressed in dB, for the case in which the Q value of the antenna alone is 1. In these drawings, BS, Ti, and SUS denote brass, titanium, and stainless steel, respectively.

From FIG. 4 and FIG. 5, it can be understood that the decrease in gain and attenuation of the Q value of the antenna, as indicated above, are mutually correlated with respect to material of metal and that the degree thereof is dependent upon the type of metal material.

Titanium and stainless steel used as the metallic material exhibit a great degree of attenuation, and because they are often used as an outer case material for watches, subsequent evaluations are made of titanium and stainless steel.

As a more specific configuration of the structure of an antenna according to the present invention, as shown in FIG. 2A and FIG. 2B, at first an antenna core part 6 and a cover part 9 are formed by sintering a manganese-zinc based ferrite and after forming coil parts 7 in which 400, 600, 800, and 1,000 turns of a conductive wire having a conductor diameter of 45 μm and a wire diameter of 67 μm were wound in a straight line onto the antenna core part 6, an epoxy adhesive into which was mixed a spacer (resin beads having a diameter of approximately 50 μm) was applied to the support part 11 of the joining part 10 and, as shown in FIG. 2B, the antenna part 8 and the cover part 9 were assembled and adhered together.

Also, the dimensions of the antenna structure 2 were an outside length of 10 mm, a width of 4 mm, and a thickness of 3.5 mm, and the core cross-section of the antenna core part 6 of the coil part 7 was 1.5 mm×1.5 mm, the coil part 7 length being 6.5 mm and the material thickness of the cover part 9 being 0.5 mm.

The inductance of the 800-turn (T) sample was 78 mH; the self-resonant frequency was 200 kHz. With regard to the inductance, in contrast to an inductance of 11 mH for the case in which the cover part 9 was not mounted, there was an approximately 7-fold increase for the case of mounting the cover part 9.

The results of measuring the antenna gain and Q value are shown in Table 4 and Table 5.

The capacitance for resonance was adjusted for the measurement so that the resonant frequency was substantially 40 kHz.

Table 4 shows the gain of the antenna alone for the various samples with different numbers of coil turns, and for the purpose of comparison Table 5 shows, for the 800-turn sample, the case of the antenna alone, the case of the antenna in contact with a stainless steel plate like member, and the case of the antenna disposed, as shown in FIG. 1, inside a watch outer case made of titanium.

TABLE 4

| | 400 T | 600 T | 800 T | 1000 T |
|---|---|---|---|---|
| Antenna gain | −43 dB | −38 dB | −35 dB | −33 dB |

TABLE 5

| | Antenna Alone | In proximity to a metal plate like member | Inside metal outer case |
|---|---|---|---|
| Antenna gain | −35 dB | −38 dB | −43 dB |
| Antenna Q value | 103 | 76 | 55 |

From the results shown in Table 4, although a tendency to saturation is shown, there is an improvement in the antenna gain accompanying an increase in the number of coil turns within the range of turns of the prototyped samples. From the results shown in Table 5, it was verified that the antenna gain attenuation even in the case in which it is disposed inside a titanium outer case is approximately 8 dB (approximately 6 dB, or a reduction of 50% if the attenuation of the external magnetic flux is considered), and the Q value reduction was also approximately one-half, thereby indicating a sufficiently high Q value, providing verification that it is possible to expect sufficient filtering characteristics with respect to noise.

If the above results are compared with the characteristics with the antenna structure of the past and, disposed inside a metal outer case, shown in FIG. 1 and FIG. 2 (antenna gain and Q value of reduced by approximately 30 dB or to approximately 1/40) it can be seen that a great improvement can be achieved by adopting the structure of the antenna structure 2 of the present invention. Also, considering the results shown in Table 3, it can be judged that the antenna gain is of a level that would present no problems for practical use.

Additionally, although it is not related to antenna characteristics, it is possible to increase the shock resistance by causing a molding resin to flow into the gap between the coil part 7 and the cover part 9 of the antenna structure 2 and solidifying it thereafter as shown in FIG. 2A and FIG. 2B. In the case of applying the antenna structure 2 of the present invention to a wristwatch, a serious problem exists of shock imparted upon dropping damaging the antenna structure 2 so that it does not function, and the ability to sufficiently tolerate shock is an important required condition for product development.

Next, a study was done, varying the shape of the cover part 9 (part covering the coil part 7) in the antenna structure 2 according to the present invention.

A dicing cutter was used to cut the cover part 9 so as to fabricate a flat plate like cover part such that it covers one surface of, an L-shaped cover part such that it covers two surfaces of, a U-shaped cover part such that it covers three surfaces of, and a cover part that is a combination of a flat plate like member and a U-shape cover part such that it covers four surfaces of the antenna part 8 of FIG. 2A and FIG. 2B and, in the same manner as the above-noted sample fabrication, adhesion and fixing was done by an epoxy adhesive into which was mixed a spacer (resin beads having a diameter of approximately 50 μm).

The antenna part 8 uses a coil part 7 with a 800 turns of a conductive wire having a conductor diameter of 45 μm and a wire diameter of 67 μm were wound in a straight line on the antenna core part 6, and the capacitance for resonance was adjusted for the measurement so that the resonant frequency was substantially 40 kHz.

Figure 9:
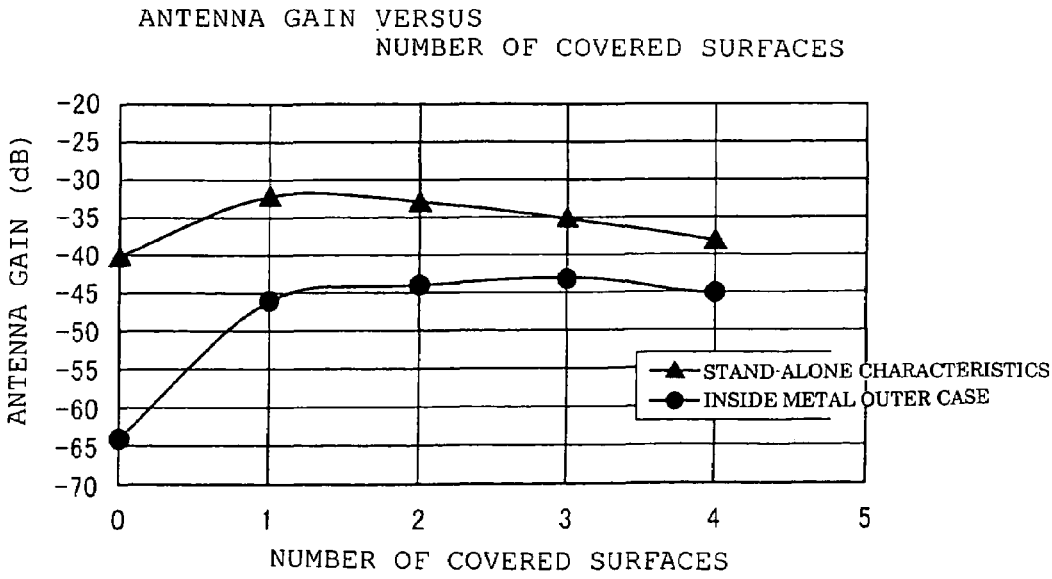
FIG. 9 is a graph showing the relationship between the antenna gain and the cover part width (number of covering surfaces).
Figure 14:
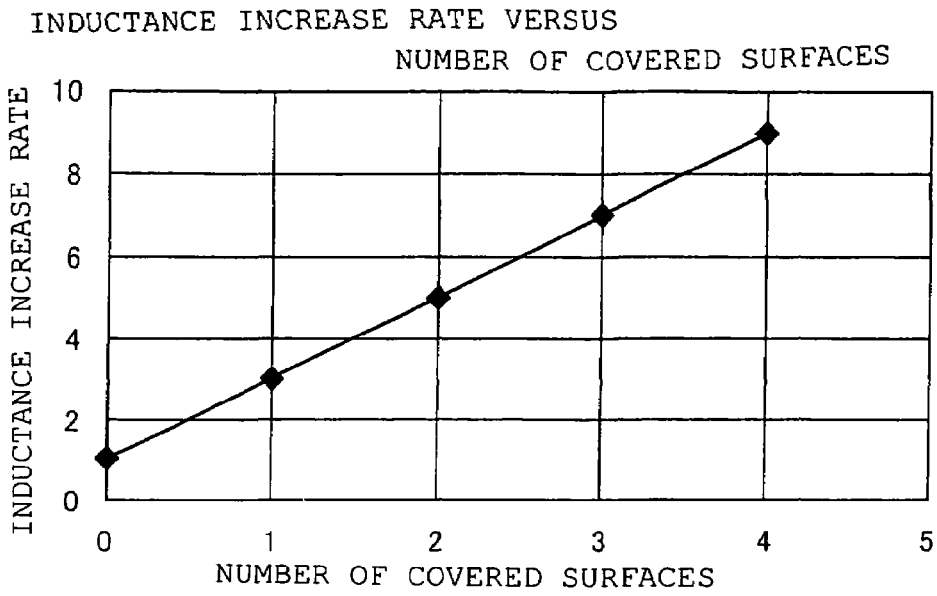
FIG. 14 is a graph showing the relationship between inductance increase rate and the cover width (number of covering surfaces) in an antenna structure according to the present invention.

The results of the measurements are shown in FIG. 9 and FIG. 14. FIG. 9 shows the antenna gain for the cases of the antenna alone and the antenna being disposed inside a titanium metal outer case, for the purpose of evaluating the effectiveness of the antenna structure 2 according to the present invention.

FIG. 14 indicates, as a reference, the rate of increase in inductance due to the mounting of various cover part samples.

From FIG. 9 it can be seen that, in order to achieve an antenna gain −40 to −45 dB, which is the minimum limit for practical use, it is necessary to cover at least one surface of the antenna part.

The reduction in the gain of the antenna in the case in which the antenna is disposed inside a metal outer case, compared to the gain of the antenna of the antenna structure 2 alone becomes smaller as the number of covered surfaces increases.

From FIG. 14, this is thought to be because, by the increase in the rate of inductance increase accompanying an increase in the number of covered surfaces, it becomes easier for the magnetic flux generated with the increase in number of covered surfaces to flow through the cover part, the result being that there is a reduction in the amount that leaks to the outside of the antenna structure.

Additionally, from FIG. 9 it is thought that the reason that the antenna gain does not increase in proportion to the increase in rate of increase of the inductance (increase in the inductance) is that the increase in inductance lowers the self-resonance frequency, so that there is an apparent increase in loss at the measurement frequency (40 kHz), resulting in the antenna gain not increasing.

Figure 7:
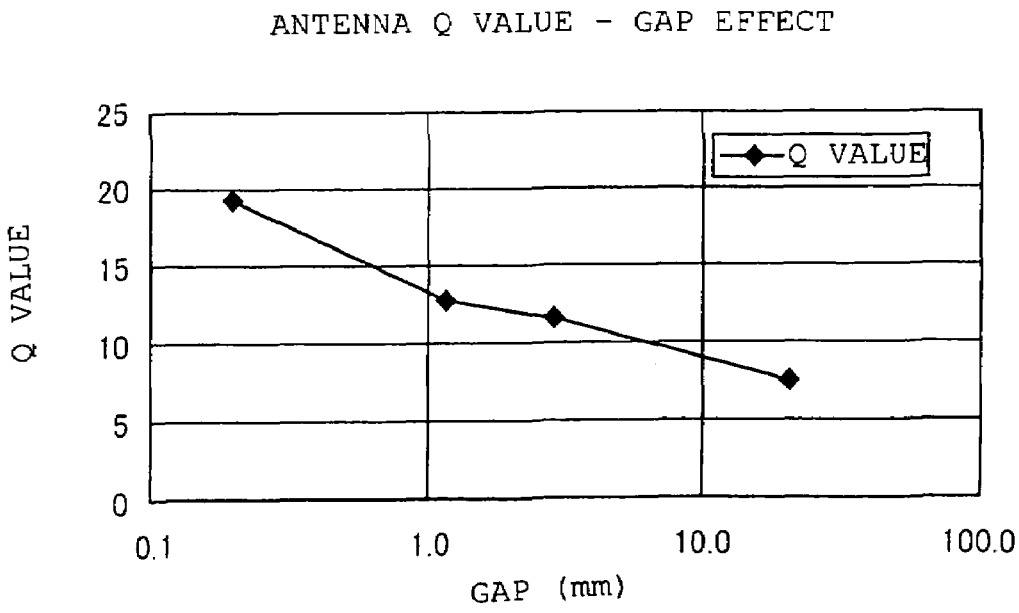
FIG. 7 is a graph showing the relationship between the magnetic gap width and the Q value.

FIG. 7 is a graph showing the relationship between the antenna characteristics obtained from a different sample and the magnetic gap, this showing the relationship between the magnetic gap of the joining part 10 and the Q value.

As can be understood from FIG. 7, because the antenna Q value can be improved by adjusting the gap, it is possible to improve the antenna gain as well.

Additionally, in the present invention it is possible to achieve a further improvement by optimizing the number of turns in the coil.

As noted above, even in the case in which the antenna structure 2 according to the present invention is in contact with or in the vicinity the metal outer case 3, there is a great reduction in the rate of decrease in the Q value, so that in practice, regardless of the existence or non-existence of this metal material, it is possible to easily and at low cost obtain an antenna structure 2 that exhibits good receiving performance.

Additionally, a further detailed configuration of an antenna structure according to the first embodiment of the present invention is described in detail below, with references made to drawings.

The structure of the antenna according to the present invention, as shown in FIG. 2A and FIG. 2B, is such that an antenna core part 6 and cover part 9 are formed by sintering of a manganese-zinc based ferrite, with the core part 7 formed by winding in a straight line 800 turns of a conductive wire having a conductor diameter of 45 μm and a wire diameter of 67 μm onto the core part 6, after which an epoxy adhesive into which is mixed a spacer (resin beads having a diameter of approximately 50 μm) is applied to the support part 11 of the joining part 10, so as to assemble and adhere together the antenna part 8 and the cover part 9 as shown in FIG. 2B.

Also, the dimensions of the antenna structure 2 were an outside length of 10 mm, a width of 4 mm, and a thickness of 3.5 mm, and the core cross-section of the antenna core part 6 of the coil part 7 was 1.5 mm×1.5 mm, the coil part 7 length being 6.5 mm and the material thickness of the cover part 9 being 0.5 mm.

A further-detailed description of the configuration of the joining part 10 in the present invention is presented below.

As a definition of the joining part 10 in the present invention, the configuration of the joining part 10 is such that the antenna core part 6 and the cover part 9 are joined via a non-metallic material, a non-metallic material having a magnetic transmuted film layer with a low permeability, or a magnetic gap, including an air gap, the antenna core part 6 and cover part 9 being made of a soft magnetic material.

The soft magnetic material is, for example, a ferrite-based soft magnetic material, a soft magnetic material in which a fine powder of cobalt or cobalt alloy is blended into a resin, or a compound soft magnetic material formed by the lamination of cobalt or cobalt alloy thin films.

In the joining part 10 of the present invention, the width of the magnetic gap of the joining part 10 is an important element in determining the antenna characteristics.

Essentially, if the magnetic gap of the joining part 10 is either too wide or too narrow, there is an adverse affect on the characteristics of the antenna structure 2, so that problems arise for use as a product.

Specifically, if the magnetic gap of the joining part 10 provided between the antenna core part 6 and the cover part 9 is too wide, it is not possible to form a sufficient closed magnetic path by the antenna core part 6 and the cover part 9, and there is a large amount of magnetic flux generated at the time of resonance which leaks to the area surrounding the antenna structure 2, so that in the case of disposing an antenna inside a metal outer case, the interaction between magnetic flux leaking to the area surrounding the antenna and the nearby metal outer case (generally thought of as being eddy losses) causes a loss of energy and a drop in the Q value, resulting in a decrease in the antenna output voltage, so that it is not possible to achieve sufficient effect as the present invention.

On the other hand, in the case in which the magnetic gap of the joining part 10 is made as small as possible, so that the antenna core part 6 and the cover part 9 are together as one, this being the case in which the soft magnetic material forming the antenna core part 6 and the cover part 9 are connected in a ring, so that there is a completely closed magnetic path, although there is no magnetic flux leakage at the time of resonance, the effective permeability of the antenna (in the example of the antenna used in the present invention for the case of not providing the cover part 9, the effective permeability was a relative permeability of approximately 20 to 30) becomes the permeability of the soft magnetic material forming the antenna core part 6 and the cover part 9 (the relative permeability being approximately 1000 to 2000 for the manganese-zinc based ferrite using in this embodiment), and because the antenna inductance is proportional to the effective permeability of the antenna, the inductance increase by a ratio of several tens to 100 times. If the inductance becomes extremely large, because the coil part 7 has parasitic capacitance, the antenna self-resonance frequency drops by an extreme amount (to a frequency that is 1/5 or 1/10), making it impossible with an externally connected resonance capacitor to adjust the resonant frequency to the prescribed frequency (receiving frequency).

Also, if the number of coil turns is made small in order to reduce the inductance and increase the self-resonance frequency, although it is possible to adjust the resonant frequency to the prescribed frequency, it is necessary to reduce the number of coil turns to approximately 1/10, thereby resulting in a drop in the antenna output voltage, which is proportional to the number of coil turns.

Additionally, if a completely closed loop is formed, much of the magnetic flux from the external radio signal entering the antenna flows in the cover part 9 and in a side thereof onto which the coil is not wound, thereby resulting in a reduction in the amount of magnetic flux contributing to the antenna output voltage, so that the antenna output voltage decreases. In this case as well, it is not possible to sufficiently achieve the effect of the present invention.

It is therefore necessary to perform control of the width of the magnetic gap of the joining part 10 so that it is an appropriate value.

In order to sufficiently achieve the effect of the present invention, it is necessary not only to adjust the gap width of the magnetic path so as to reduce the amount of leakage of magnetic flux to the area surrounding the antenna to a level at which the reduction in the antenna voltage output is not a problem (the goal was to limit the reduction in the antenna voltage output caused by installing the antenna inside a metal outer case was less than 50%), but also to use an externally connected resonance capacitance so as to achieve a self-resonance frequency that is sufficiently higher than the prescribed frequency (receiving frequency), and to make a setting so that a large amount of the magnetic flux from the external radio signal entering the antenna flows in the antenna core part 6 side onto which the coil is wound. Stated in other terms, the adjustment is made so that, as seen from the magnetic flux of an external radio signal, the magnetoresistance of the cover part 9 including the magnetic gap of the joining part 10 is larger than the magnetoresistance of the antenna core part 6.

From the results of testing and evaluation, it was discovered that this setting needs to be made so that the effective permeability of the antenna with the cover part 9 provided is 2 to 10 times, and preferably 4 to 8 times the effective permeability of the antenna comparing with that obtained in the case in which the cover part 9 is not provided. Stated differently, it is necessary that the inductance of the antenna with the cover part 9 provided to be 2 to 10 times, and preferably 4 to 8 times the inductance of the antenna in the case in which the cover part 9 is not provided.

This type of setting can be made by adjusting the joining surface area of the magnetic gap of the joining part 10 and the magnetic characteristics of the material that forms the magnetic gap.

The setting made in this case is a setting of the effective permeability or inductance of the antenna according to the present invention, and is the setting of the effective permeability or inductance of the antenna to an appropriate size so that it is possible to sufficiently exhibit the effect of the present invention. The method of doing that, seen in terms of magnetoresistance, is to either make the shape of the magnetic gap, this being the width of the magnetic gap narrow, or to make the surface area of the joining part 10 large, or alternatively to change the relative magnetic permeability of the material to within the range below the permeability of the soft magnetic material making up the antenna core part 6 and the cover part 9, so as to made the effective permeability or inductance of the antenna large.

However, in the case of an antenna used in a radio-controlled timepiece such as in the present invention, because of the need to house the antenna within a metal outer case there is a restriction in outer dimensions, and it is preferable to make the magnetic gap small without an increase in the outer dimensions, or to use a method of adjustment of the magnetic characteristics of the material making up the magnetic gap.

In the case of using an adjustment and setting method according to the magnetic gap width, in order to perform setting and adjustment of the effective permeability or inductance so that there is sufficient exhibition of the effect of the present invention, it is necessary with an opposing surface area of approximately several square millimeters, to maintain a stable gap width of 1 mm or less, and preferably 0.2 mm or less. If it is not possible to adjust, set and stably maintain such as gap, there is a large amount of manufacturing variation in the receiving characteristics (voltage output) of the antenna, or this leads to changes with the passage of time.

A specific method for forming the above-noted magnetic gap in the present invention is described in detail by example below.

Specifically, a first method is a method of establishing the positions of the antenna core part 6 and the cover part 9 using a suitable jig, and setting the gap width, and pouring an adhesive into the gap part in that condition to fix it and form it as one piece.

The adhesive that can be used in the present invention includes a generally used organic adhesive, for example an epoxy-based adhesive, a urethane-based adhesive, a silicone-based adhesive, an acrylic-based adhesive, a nylon-based adhesive, a cyanoacrylate-based adhesive, a rubber-based adhesive, urea resin-based adhesive, a melamine-based adhesive, and a vinyl-based adhesive or the like.

Figure 6:
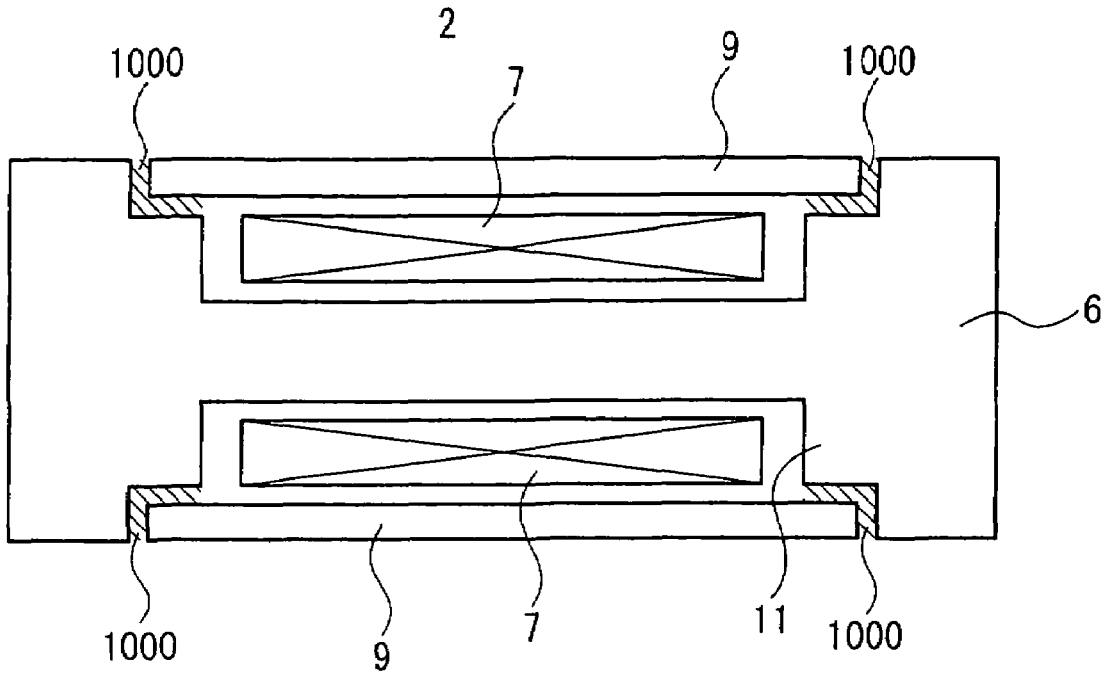
FIG. 6 is a cross-sectional view showing the configuration of a specific example of a magnetic gap of an antenna structure according to the present invention.

Next, the second method of forming the gap is the method, as shown in FIG. 6, of applying an adhesive 1000, into which a filler formed by glass or resin beads of uniform diameter which have been cut short for use as a spacer has been mixed, to the gap of the joining part 10 between the antenna core part 6 and the cover part 9, and then to push these together to adhere them, so as to establish a gap width that is substantially equal to the diameter of the spacers.

A third method of forming the gap is the method of setting the gap width by sandwiching a resin film 1000 having a uniform thickness into the gap part as a spacer and pressing the antenna core part 6 and cover part 9 up against each other via the resin film 1000 using a screw holding method or the like at the location in the radio-controlled timepiece at which the antenna is mounted.

In a fourth method of forming the gap can be the method of directly inserting the adhesive 1000 itself between the opposing surfaces of the antenna core part 6 and the cover part 9 or the method of sandwiching between the opposing surfaces of the antenna core part 6 and the cover part 9 a double-sided adhesive tape 1000 onto the surfaces of the prescribed base material of which is applied an adhesive, and performing adhesion and fixing while setting the gap width by the thickness of the double-sided adhesive tape.

In addition, it is possible to provide the magnetic gap of the joining part 10 at both or only one of the two joining parts 10 between the antenna core part 6 and the cover part 9.

Next, when forming the gap in the present invention, in the case of using a ferrite-based sintered material, for example, a manganese-zinc based ferrite as the soft magnetic material forming the antenna core part 6 and the cover part 9, even if the antenna core part 6 and the cover part 9 are in intimate contact the behavior is different from the case of using a metallic soft magnetic material such as, for example, magnetically annealed permalloy, the effective permeability or inductance of the antenna predicted from result of relative permeability of 1000 to 2000 obtained by evaluating evaluation samples formed in the shape of rings did not show variation, and although it is dependent upon the shape of the joining part 10 between the antenna core part 6 and the cover part 9, there was only a increase of between several to 10 times in the effective permeability or inductance. From these results, it is thought that, for the case of a ferrite-based sintered material, that by some reason for example by some departure from the chemical composition at the surface of the material at the time of sintering causes an extremely thin film of several tens of millimeters that is magnetically transmuted thin film and does not exhibit the intended magnetic characteristics, and it is this transmuted layer that serves as the magnetic gap in the present invention.

Soft magnetic materials generally exhibit structural sensitivity (of the crystalline structure). In the case of permalloy, for example, when cold rolling and cutting are performed, there is a disturbance to the crystalline structure overall of the material or on a surface in the vicinity of the cutting portion, and a deterioration of the magnetic characteristics. For this reason, it is necessary to perform magnetic annealing after such machining to remove deformations in the crystalline structure and restore the magnetic characteristics. Even in the case of a ferrite material, it is known that there is a deterioration in the magnetic characteristics at a surface or in the vicinity thereof that has been polished, and that departure from the intended chemical quantities of metal additives can cause a deterioration in the magnetic characteristics, so that a similar phenomenon occurs.

Figure 16:
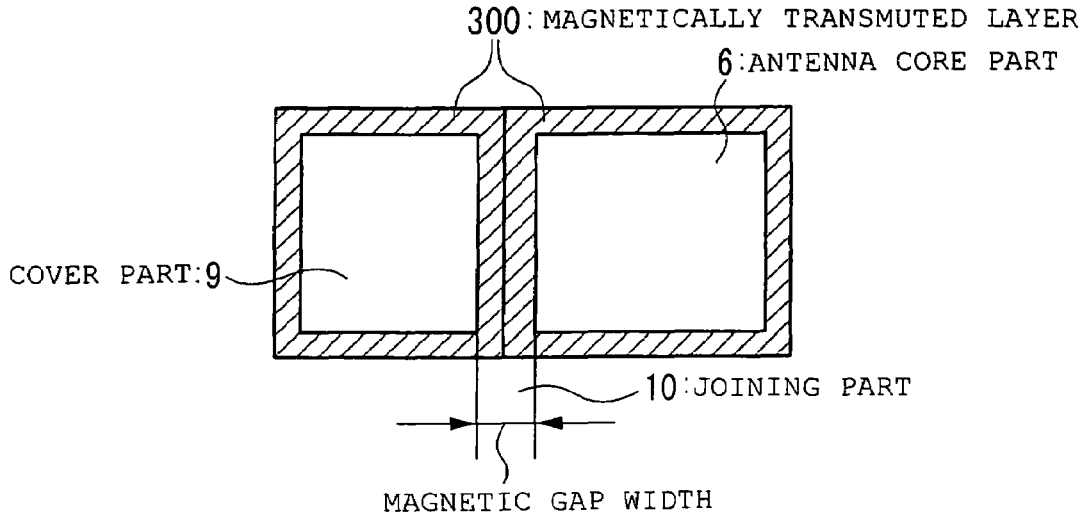
FIG. 16 is a cross-sectional view showing the configuration of a specific example in which a magnetic gap is formed in the antenna structure according to the present invention.

For this reason, in the case of using a ferrite-based sintered material as a soft magnetic material in forming the antenna core part 6 and cover part 9, as shown in FIG. 16, although there is no apparent gap between the antenna core part 6 and the cover part 9 if they are caused to be in intimate contact, the antenna core part 6 and the cover part 9 are in contact via a magnetically transmuted layer 300 at the surface, and as a result the magnetically transmuted layer 300 sets the width of the magnetic gap of the joining part 10. That being the case, in the case in which the antenna core part 6 and the cover part 9 are formed using a ferrite-based sintered material, it is possible, to bring the antenna core part 6 and cover part 9 into intimate contact, without forming an apparent gap therebetween, and to adjust the surface area of the intimate contact at the joining part 10 so as to perform adjustment and setting of the effective permeability or inductance.

In this case, because the setting of the width of the magnetic gap is made by the thickness of the magnetically transmuted layer, either the antenna core part 6 and cover part 9 are abutted to one another after application of the adhesive or the adhesive is caused to flow therebetween from a dispenser or the like after they are abutted together.

As noted above, even if the antenna structure 2 of the present invention is disposed inside of a metal outer case 3, the reduction in the Q value and gain value thereof are greatly suppressed, so that from a practical standpoint it is possible, regardless of the existence or non-existence of the metal outer case 3, to easily and economically obtain an antenna structure 2 that exhibits good receiving performance.

In the present invention the frequency that can be received by the antenna structure 2 is a long-wave radio signal at 2000 kHz or below, and is preferably a long-wave signal from several tens of kilohertz to several hundreds of kilohertz.

It is desirable that the metal outer case 3 in the present invention either have a structure that is formed by a side part and a bottom cover part made of metal and configured so as to be able to house the antenna structure 2 therewithin, or a structure in which the side part and the bottom cover part made of metal and integrally formed as one so as to be able to house the antenna structure 2 therewithin.

The metal outer case 3 used in the present invention specifically uses an electrically conductive metal that is stainless steel, brass, titanium or a titanium alloy, gold, silver, platinum, nickel, copper, chromium, aluminum, or a an alloy thereof.

Preferable metals for the outer case 3 in the present invention are brass, stainless steel, titanium, and a titanium alloy.

Additionally, a specific example of a metal other than the outer case 3 disposed in the vicinity of the antenna structure 2 of the present invention is one that includes a metal material which are constructual elements to form a movement of a watch such as a battery, including a solar battery, a converter, a gear train, a microcomputer, or a member made of metal, such as a dial plate, wrist band or the like.

Embodiment 2

Next another specific example of the antenna structure 2 according to the present invention is described below.

Figure 11:
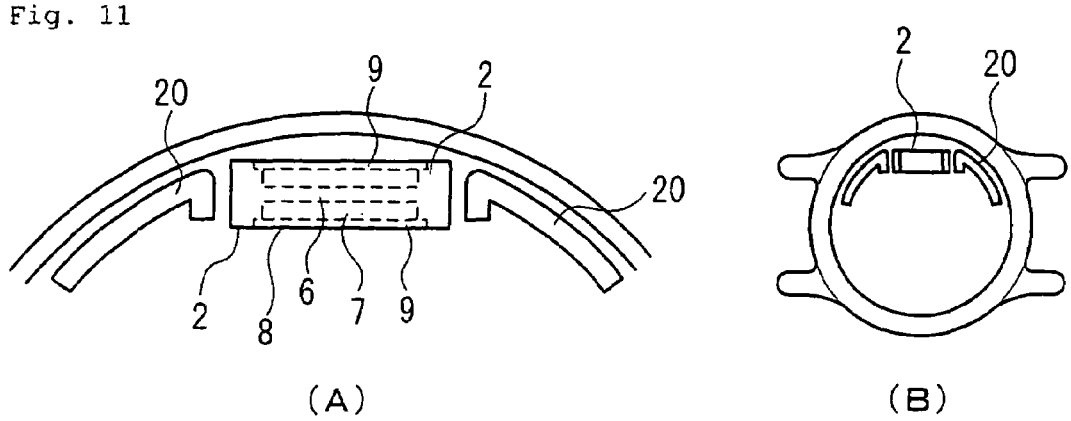
FIG. 11 is a drawing showing another specific example (with a collector) of the placement of various components in a radio-controlled timepiece according to the present invention.

Specifically, the antenna structure 2 of this specific example has, for example, collectors 20 and 20' made of a soft magnetic material, which provide additional collection of a radio signal from the outside, formed at the two end parts 71 and 72 in the longitudinal direction of the antenna core part 6 in the antenna part 8 as shown in FIG. 11.

The collector 20 can be integrally formed as one with the antenna core part 6 at the outer wall parts of the end parts 71 and 72, and the collector part 20 can also be formed as a separate item from the antenna core part 6, provided so as to be in contact with or in the vicinity of the outer wall part of the end parts 71 and 72.

It is desirable that the cross-sectional area of the collector part 20 perpendicular to the longitudinal direction be smaller than the cross-sectional area perpendicular to the longitudinal direction of the antenna core part 6.

Additionally, it is desirable that the collector part 20 in this specific example, as illustrated in FIG. 11, be curved or bent along its longitudinal axis so as to conform to the shape of the metal outer case 3 of a watch or the like.

As more detailed description of the collector part 20 in this specific example, as shown in FIG. 11 the collector part 20 made of a soft magnetic material that provides additional collection of an external radio signal is provided on the longitudinal direction ends 71 and 72 of the antenna core part 6, and the collector part 20 in this specific example can also formed, not as one with the antenna core part 6, but as a separate sintered piece made of a manganese-zinc based ferrite.

The shape of the collector part 20 is made an arc so that it easily conforms to the inside configuration of the outer case 3 , and surface that opposes the antenna core part 6 is made substantially the same dimensions so that it can make intimate contact. The cross-section of the collector part 20 having an arc configuration has a width of 1 mm and a thickness of 2 mm, and the length is approximately 7 mm.

Figure 15:
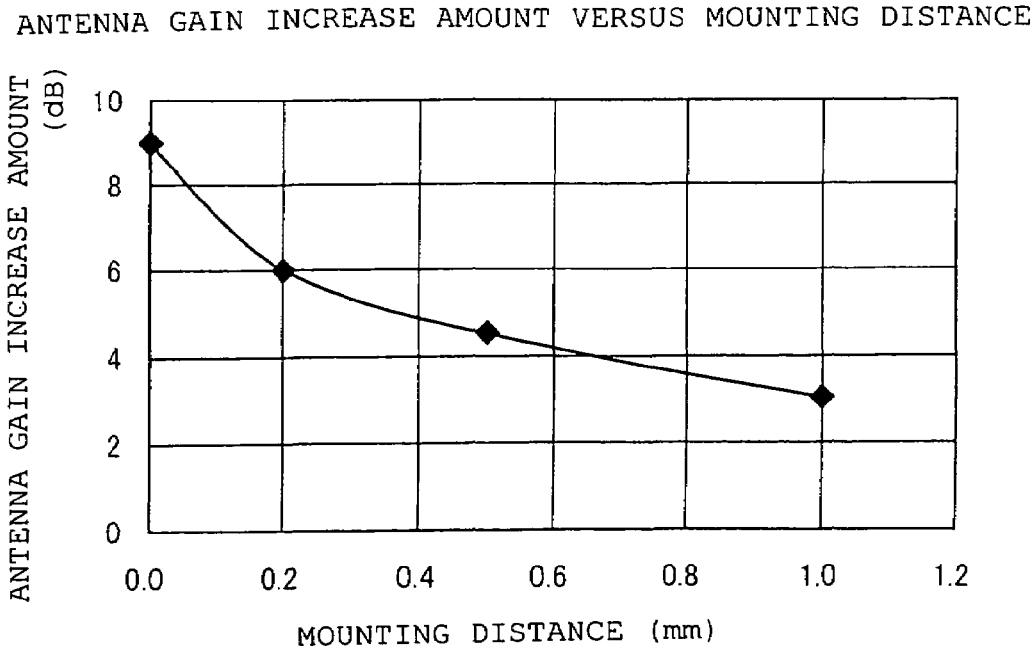
FIG. 15 is a graph showing the relationship between the antenna gain increase amount due to effect of the collector and the installation distance in an antenna structure according to the present invention.

The results of gain measurements made with varied length (distance) between the antenna core part 6 and the collector parts 20 are shown in FIG. 15. The measurements were performed with a resonance capacitance adjusted so that the resonant frequency was substantially 40 kHz, with the antenna disposed in a metal outer case made of titanium.

As can be understood from FIG. 15, there is an increase in antenna gain by placement of the collector part 20. The maximum is when there is intimate contact between the antenna core part 6 and the collector part 20, there being an improvement of approximately 9 dB (somewhat less than a three-fold increase in output voltage), and it can be seen that, as the distance between the antenna core part 6 and the collector part 20 increases, the effect of improvement in the gain by the collector part 20 decreases. Also, the improvement in the antenna gain under in this situation is not due to an improvement in Q value, but rather to a simple improvement in the antenna gain. From this, it is thought that the action of the collector part 20 is to collect magnetic flux from the external radio signal and pass the flux to the antenna core part 6.

From the above results, in order to maximize the effect of the collector part 20 it is desirable that the antenna core part 6 and the collector part 20 be integrally formed as one, and in the case of formation as a separate item, it is desirable to dispose the collector part 20 as close as possible to the antenna core part 6.

Although in this specific example the collector part 20 was disposed at both the ends of the antenna core part 6 in the longitudinal direction, it can also be disposed at one end only.

As noted above, in the present invention, by disposing a collector part 20 at both ends or at one end of the antenna core part 6 it is possible to further improve the gain of the antenna structure 2, and even in the case in which the antenna structure 2 in the present invention exists inside or in the vicinity of the metal outer case 3, it is possible not only to greatly reduce the rate of decrease in the Q value but also to improve the antenna gain, so that, from a practical standpoint, it is possible, regardless of the existence or non-existence of the metal object, to easily and economically obtain an antenna structure 2 that exhibits good receiving performance.

Embodiment 3

Next, a third embodiment of the second aspect of the present invention is described below.

Figure 8:
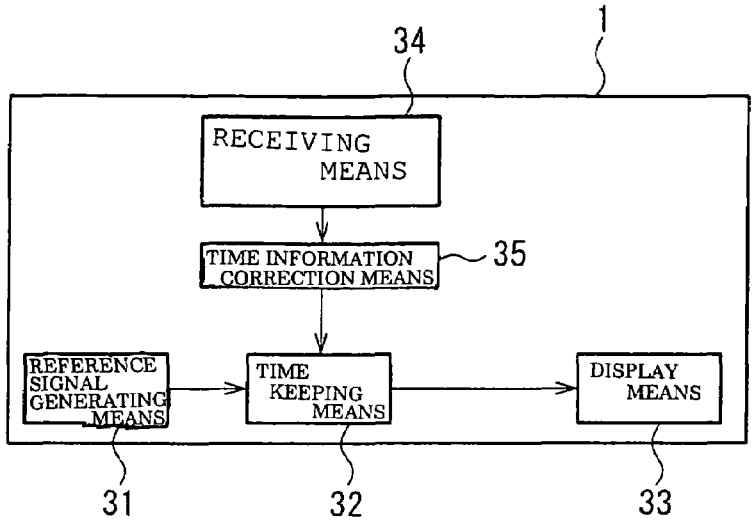
FIG. 8 is a block diagram showing an example of the configuration of a radio-controlled timepiece according to the present invention.

Specifically, a second aspect of the present invention, as shown in FIG. 8, is a radio-controlled timepiece 1 having a reference signal generating means 31 for generating reference signals, a timekeeping means 32 for outputting timekeeping information based on the reference signal, a display means 33 for displaying the time based on the timekeeping information, and a receiving means 34 for receiving a standard radio signal having standard time information, and a time information correction means 35 which corrects the output time information of the timekeeping means based on the received signal from the receiving means 34, and in that the receiving means 34 includes an antenna structure 2 having any of the structures noted above and a receiving circuit.

It is preferable that the radio-controlled timepiece 1 in this specific example either has an outer case made of a metal material and has a bottom cover part made of a metal material, or at least the side part or the bottom cover part is made of a metal material.

The radio-controlled timepiece 1 according to the present invention is a radio-controlled timepiece or a remotely controlled wrist watch that receives a radio signal onto which is superimposed a timecode so as to automatically adjust the time of the wristwatch to the standard time during use.

Figure 10:
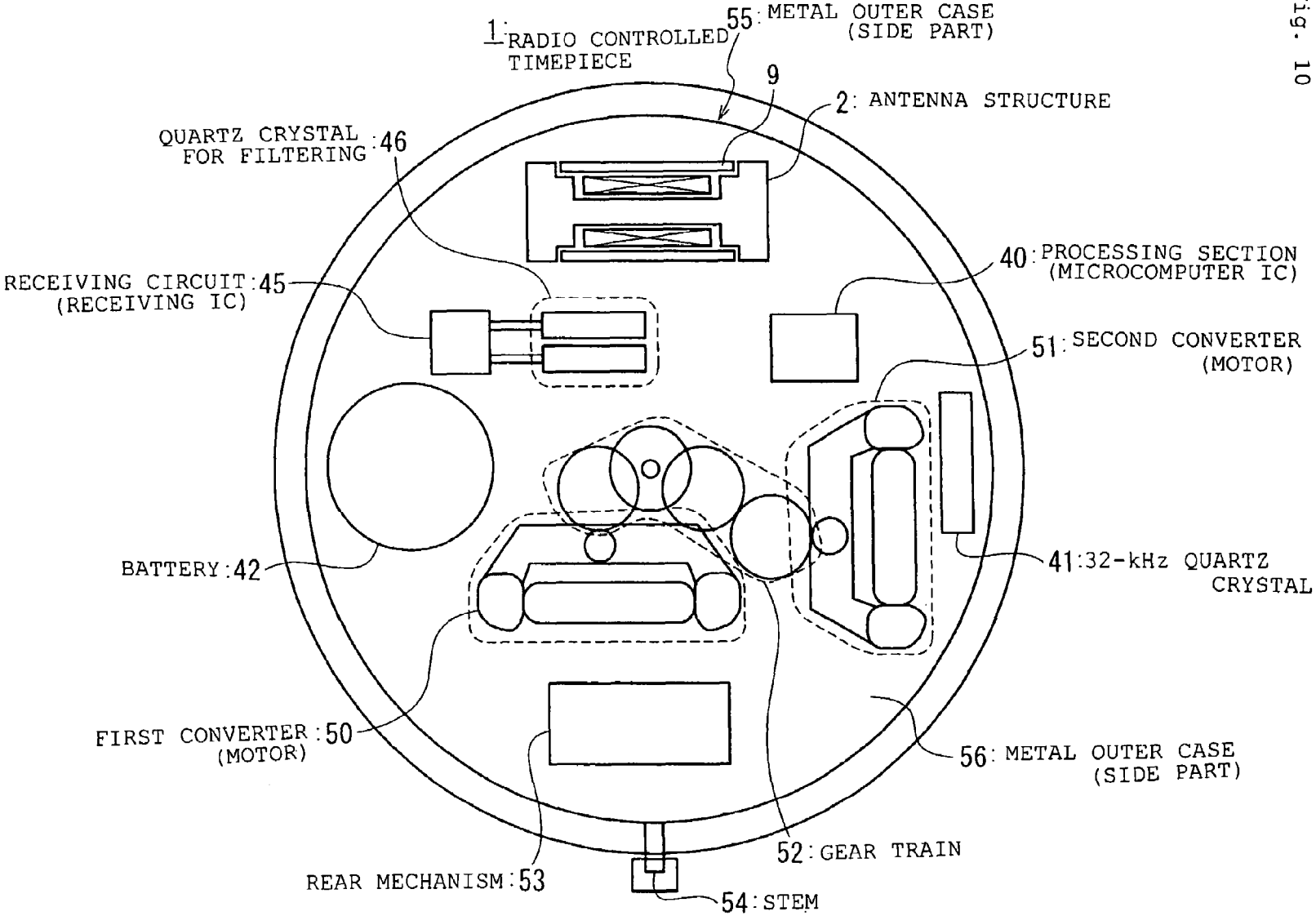
FIG. 10 is a drawing showing one specific example of the placement configuration of various components in a radio-controlled timepiece according to the present invention.

With FIG. 10 showing a more detailed specific example the radio-controlled timepiece 1 according to the present invention, the radio-controlled timepiece 1 is shown to have a configuration in which an antenna structure 2 having a configuration such as shown in FIG. 7 is disposed at a position in the vicinity of the side part 55 of a metal outer case 3.

In FIG. 10, 45 is a receiving circuit (receiving IC), 46 is a quartz crystal for the purpose of filtering, 41 is a 32-kHz quartz crystal for the purpose of timekeeping, 52 is a gear train for the purpose of causing hour and minute hands and the like to operate, 54 is a stem,53 is a the rear mechanism, 50 is a first converter (motor), 51 is a second converter (motor), 42 is a battery, 40 is a microcomputer forming a processor that includes a timekeeping means, a time correcting means or the like, and 56 is a bottom cover of the watch outer case, which is made of a metal material.

The radio-controlled timepiece 1 in the present invention has side part 55 and a bottom cover part 56 of the metallic outer case of the watch, the antenna structure 2 being disposed within the side part 55 and bottom cover part 56 and in some cases at least one part of the antenna structure 2 can be in contact with the side part 55 and the bottom cover part 56.

Although only one converter is the sufficient minimum number for watch operation, because of the watch hands (hour, minute, and second) and for the purpose of freedom of calendar operation, a plurality of converters are generally used in a functional watch.

The radio-controlled timepiece 1 shown in FIG. 10 is, of course, just one example of the placement configuration and, as noted above, because the influence on the antenna structure 2 of electrically conductive objects made of metal is small, there is flexibility in the placement relationship with other components, thereby enabling many variations that can be envisioned.

Figure 18:
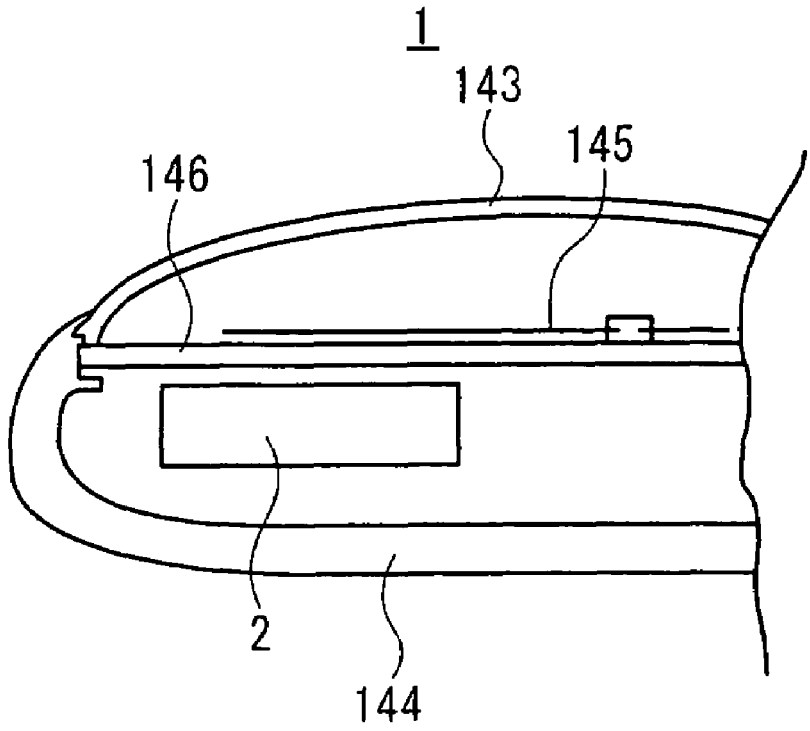
FIG. 18 is a cross-sectional view showing the disposition of the antenna structure in radio-controlled timepiece according to the present invention.

Also, in another specific example of the present invention, as shown in FIG. 18, it is a preferable one in that the antenna structure 2 is provided on the side of the dial plate 46 that is opposite from the side on which the wind shield 43 is provided.

In FIG. 18, 144 is an electrically conductive outer case made of a metal material and 145 is the hour hand and minute hand that form the display means.

In the first specific example of the present invention, by adopting the above-described constitution, the problems in the prior art are solved, without making a great change with regard to the construction, outer case material, or design and the like as used in the past, an antenna structure of simple construction being adopted, enabling the easy achievement of an antenna structure and a radio-controlled timepiece using the antenna structure, which enable good receiving performance, without any difference in the size or thickness relative to a watch of the past, with a high degree of freedom of design, and reduced manufacturing cost.

Additionally, even in the case in which the antenna is housed inside a metal outer case, it is easy to achieve a radio-signal controlled watch having a high value as a product, without causing a reduction in the gain.

Because the antenna structure of the present invention adopts the above-noted technical constitution, it enables the minimization of the decrease in antenna output, even when an antenna structure 2 is placed in the vicinity of the metal object such as an metal outer case of the watch.

Additionally, because radio-controlled timepiece of the present invention has a built-in antenna structure, and also uses a metal outer case, it is possible to provide a radio-controlled timepiece that is compact, thin, and has a feeling of high quality, without greatly changing the structure or design and the like with respect to wristwatches of the past. Also, because of the use of a metal outer case the same as wristwatches of the past, the freedom of design is high, and it is possible to achieve a low manufacturing cost.

The antenna structure according to the present invention is used in general radio-signal controlled watches, and is particularly usable as an antenna structure with superior radio receiving performance in a compact, lightweight radio-signal controlled watch having a metal case.

The invention claimed is:

1. An antenna structure capable of receiving an external radio signal, said antenna structure comprising a magnetic path that enables reception of magnetic flux caused by an external radio signal, but makes it difficult for magnetic flux generated by resonance to leak to said outside of said antenna structure, said magnetic path being formed minimally by an antenna part, which is formed by at least one antenna core part and a coil part formed by winding of a conductive wire around said antenna core part, and a cover part disposed in a vicinity of said antenna part and covering at least a part of said antenna part, said antenna core part and cover part being made of a soft magnetic material, and also said cover part being fixed to said antenna part at both ends of said antenna core part of said antenna part, wherein said cover part and said antenna part form a substantially closed magnetic path, and said magnetic flux generated by resonance flows through said substantially closed magnetic path.

2. An antenna structure according to claim 1, wherein said cover part is connected via a joining part to said antenna core part of said antenna part.

3. An antenna structure according to claim 1, wherein a part of said substantially closed magnetic path formed by said antenna core part and said cover part of said antenna structure includes a part having a permeability that is different from said permeability of other parts.

4. An antenna structure according to claim 1, wherein said cover part covers said entire periphery of said antenna part.

5. An antenna structure according to claim 1, wherein said cover part is formed by a member having a thickness that is thinner than said maximum length of a cross-section of said center part of said antenna core part of said antenna part.

6. An antenna structure according to claim 1, wherein said cover part has an overall cross-sectional shape that is a one-configuration selected from a group consisting L-shaped, channel-shaped (U-shaped), bent shaped, curved shaped, rounded shaped and a closed polygonal shaped configurations or a combination thereof, made from a plate like member or a plurality of said plate like members being integrally assembled to each other.

7. An antenna structure according to claim 1, wherein said length of said cover part in said longitudinal direction is longer than said length of said coil of said antenna part.

8. An antenna structure according to claim 1, wherein said angle of intersection formed by two straight lines joining said center of said antenna core part of said antenna part and two ends in said cross-section intersecting with said longitudinal direction of said cover part is at least 90°.

9. An antenna structure according to claim 1, wherein said cover part is made of either one of a ferrite-based soft magnetic material, a soft magnetic material in which a fine soft magnetic powder of cobalt or cobalt alloy is blended into a resin, or a compound soft magnetic material formed by said lamination of cobalt or cobalt alloy thin films.

10. An antenna structure according to claim 1, wherein said antenna core part is made of either one of ferrite-based soft magnetic material and a soft magnetic material in which a fine soft magnetic powder of cobalt or cobalt alloy is blended into a resin.

11. An antenna structure according to claim 1, wherein both end parts of said cover part provided along its longitudinal direction make contact with at least one part of both end parts of said antenna core part of said antenna part.

12. An antenna structure according to claim 11, wherein a support part which supports said cover part is provided on both end parts of said antenna core part in a longitudinal direction thereof.

13. An antenna structure according to claim 11, wherein a surface part of said cover part is formed so as to be on a plane with said outermost surface of said antenna core part, or formed at a position lower than said outermost surface of said antenna core part.

14. An antenna structure according to claim 12, wherein said support part is a step part formed on a pair of mutually opposing surfaces of both end parts of said antenna core part.

15. An antenna structure according to claim 2, wherein a magnetic gap of said joining part is either formed via a spacer, adhesive or said like, or formed as an air gap.

16. An antenna structure according to claim 1, wherein said contacting surface area of said antenna core part in said antenna part to said cover part is larger than said cross-sectional surface area of said cover part.

17. An antenna structure according to claim 1, wherein a collector part that additionally collects magnetic flux of an external radio signal is formed of a soft magnetic material provided on both of said end parts of said antenna core part in said longitudinal direction in said antenna part.

18. An antenna structure according to claim 17, wherein said collector part is integrally formed as one body with said antenna core part on an outer wall part of both end portions of said antenna core part.

19. An antenna structure according to claim 17, wherein said collector part is formed as a separate item from said antenna core part, and is provided so as to be in contact with or in proximity to an outer wall part of both ends of said antenna core part.

20. An antenna structure according to claim 17, wherein said cross-sectional area of said collector part perpendicular to said longitudinal direction thereof is smaller than said cross-sectional area perpendicular to said longitudinal direction of said antenna core part.

21. A radio-controlled timepiece comprising means for generating a reference signal that outputs a reference signal, timekeeping means for outputting timekeeping information based on said reference signal, display means for displaying a time based on said timekeeping information, receiving means for receiving a standard radio signal having standard time information, and a means for correcting said output time information of said timekeeping means based on said received signal from said receiving means, wherein said receiving means includes an antenna structure having a structure as recited in claim 1.

22. A radio-controlled timepiece according to claim 21, further comprising an outer case made of a metal material.

23. A radio-controlled timepiece according to claim 21, wherein at least one of a side part and a bottom cover part are made of a metal material.

* * * * *